US007396106B2

(12) United States Patent
Fukuyasu

(10) Patent No.: US 7,396,106 B2
(45) Date of Patent: Jul. 8, 2008

(54) INK JET PRINTING DEVICE AND IMAGE FORMING APPARATUS

(75) Inventor: Hidehito Fukuyasu, Tottori (JP)

(73) Assignee: Ricoh Company, Ltd., Tokyo (JP)

( * ) Notice: Subject to any disclaimer, the term of this patent is extended or adjusted under 35 U.S.C. 154(b) by 399 days.

(21) Appl. No.: 10/541,467

(22) PCT Filed: Nov. 12, 2004

(86) PCT No.: PCT/JP2004/017223

§ 371 (c)(1),
(2), (4) Date: Jun. 30, 2005

(87) PCT Pub. No.: WO2005/047002

PCT Pub. Date: May 26, 2005

(65) Prior Publication Data

US 2006/0146080 A1 Jul. 6, 2006

(30) Foreign Application Priority Data

Nov. 17, 2003 (JP) ..... 2003-386761

(51) Int. Cl.
*B41J 2/145* (2006.01)

(52) U.S. Cl. ..... 347/41; 347/12; 347/9; 347/43

(58) Field of Classification Search ..... 347/12, 347/41
See application file for complete search history.

(56) References Cited

U.S. PATENT DOCUMENTS 5,500,661 A 3/1996 Matsubara et al.
5,847,721 A 12/1998 Ogata et al.
6,170,932 B1 * 1/2001 Kanaya et al. ..... 347/41
6,273,542 B1 * 8/2001 Couwenhoven et al. ..... 347/19
6,318,832 B1 * 11/2001 Bates et al. ..... 347/15
6,540,326 B2 * 4/2003 Matsubara et al. ..... 347/41

FOREIGN PATENT DOCUMENTS

| | | |
|---|---|---|
| JP | 61-120578 | 6/1986 |
| JP | 3-56186 | 8/1991 |
| JP | 8-295034 | 11/1996 |
| JP | 9-234860 | 9/1997 |
| JP | 10-24562 | 1/1998 |
| JP | 11-254712 | 9/1999 |
| JP | 2001-171151 | 6/2001 |
| JP | 2001-232826 | 8/2001 |
| JP | 2002-264395 | 9/2002 |

* cited by examiner

*Primary Examiner*—Matthew Luu
*Assistant Examiner*—Brian J Goldberg
(74) *Attorney, Agent, or Firm*—Cooper & Dunham, LLP

(57) ABSTRACT

An ink jet printing device comprises a head unit, a head-unit moving unit, a recording-medium moving unit, and a control unit controlling the head unit, the head-unit moving unit, and the recording-medium moving unit. The control unit is configured to carry out printing so that a rear-end portion of discharge nozzles in an array direction after printing of a printing region and a front-end portion of the discharge nozzles in the array direction before printing of a non-printed region overlap each other with respect to a sub-scanning direction, and invalid nozzles that do not discharge ink drops are determined from among arbitrary ones of overlapping discharge nozzles including a front-end portion and a rear-end portion in the array direction of the discharge nozzles.

5 Claims, 16 Drawing Sheets

INK JET PRINTING DEVICE AND IMAGE FORMING APPARATUS

TECHNICAL FIELD

The present invention generally relates to an ink jet printing device and an image forming apparatus, applicable to, for example, copiers, printers, facsimile, multi-function peripherals, etc., and more particularly to an ink jet printing device and an image forming apparatus configured to move the head unit in the main scanning direction multiple times repeatedly for the same printing region in accordance with the array interval of the discharge nozzles.

BACKGROUND ART

Conventionally, the ink jet printing device is used in the image forming apparatus, such as copier, printer, facsimile, multi-function peripheral, etc. In this ink jet printing device, the head unit includes a plurality of recording heads provided with a plurality of discharge nozzles arranged in the sub-scanning direction, and filled up with the inks of the different colors, and high-density and high-quality printing is carried out at high speed by discharging of ink drops from the discharge nozzles of the recording head to the recording sheet according to the image signal while moving the head unit in the main scanning direction.

On the other hand, when printing on the recording sheet with such ink jet printing device, it is known that the dot density (resolution) is determined according to the physical array interval (pitch) of the discharge nozzles.

For example, as shown in FIG. 12, assuming that the pitch of the discharge nozzles 1*a*, which are arranged at equal intervals on each of the recording heads 1B, 1C, 1M, and 1Y which respectively discharge the inks of the black (B), the cyan (C), the magenta (M) and the yellow (Y), and constitute the head unit 1, is set to H, and that the pitch H is equal to 1/150 inches, the dot density according to the pitch of the discharge nozzles 1*a* is determined as being 150 dpi.

When the head unit 1 performs color printing at the resolution that is the same as the resolution (150 dpi) determined according to the array of the discharge nozzles 1*a* as shown in FIG. 13A and FIG. 13B, the head unit 1 is moved only in the main scanning direction and the discharging of the ink is carried out sequentially from the recording heads 1B, 1C, 1M, and 1Y, to the recording sheet P. In this case, the ink drops will overlap in order of B, C, M, and Y, and the color image will be printed.

In this case, if the ink discharging is performed while moving the head unit 1 in the forward main scanning direction only, the stacking order of the ink drops of the different colors will be fixed, and the printing result will become uniform.

In contrast to the above case, if the discharging of the ink is carried out while the head unit 1 is moved in the forward main scanning direction and then in the backward main scanning direction as shown in FIG. 14A and FIG. 14B, the stacking order of the ink drops for the backward scanning is reversed to that for the forward scanning. Namely, in the forward scanning, the ink drops overlap in order of Y, M, C, and B, but, in the backward scanning, the ink drops overlap in order of B, C, M, and Y. In this case, color inconsistency will occur in the printing result, and the quality of the printed image will be deteriorated.

Moreover, Japanese Published Patent Application No. 03-056186 discloses an ink jet printing device which carries out printing at a resolution higher than the resolution determined according to the array interval of the discharge nozzles 1*a*.

As shown in FIG. 15A, FIG. 15B and FIG. 16, in the ink jet printing device disclosed in Japanese Published Patent Application No. 03-056186, the high-resolution printing is achieved in the following manner. After the recording sheet P is moved to the previous printing region of the recording sheet P where the printing is performed by the main-scanning-direction movement (the first scan) of the head unit 1, in the sub-scanning direction only for the pitch H/2 which is half the pitch of the discharge nozzles 1*a*, the head unit 1 is moved in the main scanning direction so that the ink drops reach the non-printed region between the discharge nozzles 1*a* in the sub-scanning direction of the first scan.

In the example of FIG. 15A and FIG. 16, the printing of the two colors of the cyan and the magenta is illustrated for the sake of simplified explanation.

Subsequently, the printing is carried out all over the recording sheet P by moving the head unit 1 in the sub-scanning direction so that the head unit 1 is located to the non-printed region continuous to the printing region, and repeating the printing procedure.

In this case, the printing at the resolution of 300 dpi which is twice the resolution of 150 dpi is realized by moving the head unit 1 in the sub-scanning direction by ½ of the pitch H of the discharge nozzles 1*a*. Moreover, in order to realize the printing at the higher resolutions which are three times, four times, . . . higher than the resolution of 150 dpi, it is necessary to move the head unit 1 in the sub-scanning direction by ⅓, ¼, . . . of the pitch H of the discharge nozzles 1*a*.

Moreover, in the case of printing at the high resolution higher than the resolution which is determined according to the pitch of the discharge nozzles 1*a* in the above-mentioned way, the ink drops of cyan C reach the recording sheet P when the head unit 1 is scanned in the 1st time in the main scanning direction, the ink drops of magenta M reach the target locations of the recording sheet P between cyan C and cyan C when the head unit 1 is scanned in the 2nd time in the main scanning direction. Namely, the ink drops of cyan C and magenta M alternately reach the target locations on the recording sheet P, and it is possible to prevent the mutual color inconsistency on a scanning line basis on the recording sheet P from being conspicuous.

However, when the ink discharging method of Japanese Published Patent Application No. 03-056186 mentioned above is used, the ink drops of magenta M are printed in the 2nd time to the target locations between cyan C and cyan C the ink drops of which are printed in the 1st time by the head unit 1, and after the recording sheet P is moved in the sub-scanning direction greatly and the head unit 1 is moved in the main scanning direction to the non-printed region on the recording sheet P, the impact sequence of the ink drops will be reversed.

More specifically, as shown in FIG. 17A and FIG. 17B, after the head unit 1 is scanned in the 2nd time in the main scanning direction and the discharging of the ink is completed, the head unit 1 is scanned in the 3rd time in the main scanning direction and the ink is discharged to the recording sheet P. At this time, the impact timing of the ink drops of magenta M (indicated by M1 in FIG. 17B) which reached the target locations from the discharge nozzles 1*a* of the rear-end portion of the head unit 1 when the head unit 1 is scanned in the 2nd time is earlier than the impact timing of the ink drops of cyan C (indicated by C1 in FIG. 17B) which reached the target locations from the discharge nozzles 1*a* of the front-end portion of the head unit 1 when the head unit 1 is scanned in the 3rd time.

The reversing of the impact sequence of the ink drops mentioned above arises at the transitional locations between the discharge nozzles 1*a* of the rear-end portion of the head unit 1 and the discharge nozzles 1*a* of the front-end portion of the head unit 1 when the recording sheet P is moved in the sub-scanning direction greatly and then the head unit 1 is moved to the non-printed region on the recording sheet P, and consequently the problem that color inconsistency becomes conspicuous on the recording sheet P as a whole will arise.

DISCLOSURE OF THE INVENTION

An object of the present invention is to provide an improved ink jet printing device and image forming apparatus in which the above-mentioned problems are eliminated.

Another object of the present invention is to provide an ink jet printing device which can prevent the occurrence of color inconsistency on the recording medium and attain high-quality printing by maintaining the impact sequence of the ink without being reversed in the case of printing at a high resolution higher than the resolution determined according to the array interval of the discharge nozzles of the head unit.

Another object of the present invention is to provide an image forming apparatus which can prevent the occurrence of color inconsistency on the recording medium and attain high-quality printing by maintaining the impact sequence of the ink without being reversed in the case of printing at a high resolution higher than the resolution determined according to the array interval of the discharge nozzles of the head unit.

The above-mentioned objects of the present invention are achieved by an ink jet printing device comprising: a head unit in which a plurality of recording heads having discharge nozzles which discharge ink drops of different colors respectively are arranged in a main scanning direction, and the discharge nozzles of each of the recording heads are arranged at equal intervals in a sub-scanning direction which is perpendicular to the main scanning direction; a head-unit moving unit moving the head unit in the main scanning direction along a printing region of a recording medium; a recording-medium moving unit moving the recording medium in the sub-scanning direction; and a control unit controlling the head unit, the head-unit moving unit, and the recording-medium moving unit, wherein the control unit is configured to carry out printing procedures including steps of moving the recording medium to the printing region to perform the discharging of the ink drops, and moving the recording medium in the sub-scanning direction by an interval represented by the formula H/k where H is an array interval of the discharge nozzles in the sub-scanning direction and k is an integer above one, to perform the discharging of the ink drops to a non-printed region equivalent to the array interval H of the discharge nozzles, and configured to repeat the printing procedures k times according to an ink dot density, and thereafter move the recording medium in the sub-scanning direction so that the head unit is located to a next non-printed region following the printing region and the printing procedures are performed for the next non-printed region, wherein the control unit is configured so that a rear-end portion of the discharge nozzles in an array direction after printing of the printing region and a front-end portion of the discharge nozzles in the array direction before printing of the non-printed region overlap each other with respect to the sub-scanning direction, and invalid nozzles that do not discharge the ink drops are determined from among arbitrary ones of the overlapping discharge nozzles including the front-end portion and the rear-end portion in the array direction of the discharge nozzles.

By the above composition of the ink jet printing device, in the case of printing at a high resolution higher than the resolution determined according to the array interval of the discharge nozzles, when the recording medium is moved in the sub-scanning direction greatly so that the head unit is located to the non-printed region of the recording medium and performs the discharging of the ink drops there, it is possible that the impact sequence of the ink drops at the transitional locations between the discharge nozzles of the rear-end portion of the head unit and the discharge nozzles of the front-end portion of the head unit is in accordance with the impact sequence of the ink drops of another color.

For this reason, by covering the whole recording medium and maintaining the impact sequence of the ink without being reversed, the ink jet printing device of the present invention can prevent the occurrence of color inconsistency on the recording medium and attain high-quality printing.

Moreover, the above-mentioned ink jet printing device of the invention may be provided so that the control unit is configured to determine as being the invalid nozzles at least one of the discharge nozzles located in the rear-end portion in the array direction upon a final movement of the head unit in the main scanning direction for printing in the same printing region and one of the discharge nozzles located in the front-end portion in the array direction upon a first movement of the head unit in the main scanning direction for printing in the non-printed region.

By this composition, it is possible that the impact sequence of the ink drops at the transitional locations between the discharge nozzles of the rear-end portion of the head unit and the discharge nozzles of the front-end portion of the head unit is in accordance with the impact sequence of the ink drops of another color.

Moreover, the above-mentioned ink jet printing device of the invention may be provided so that, when the number k of repetitions of the movement of the recording medium by the interval H/k in the sub-scanning direction is increased, the control unit is configured to determine as being the invalid nozzles at least one of the discharge nozzles located in the front-end portion in the array direction upon each of movements of the head unit, except for a final movement, in the main scanning direction for printing in the non-printed region.

By this composition, it is possible that the impact sequence of the ink drops at the transitional locations between the discharge nozzles of the rear-end portion of the head unit and the discharge nozzles of the front-end portion of the head unit is in accordance with the impact sequence of the ink drops of another color.

Moreover, the above-mentioned ink jet printing device of the invention may be provided so that, when the number of the overlapping discharge nozzles is increased, the control unit is configured to increase the number of the invalid nozzles.

By this composition, even when the number of the overlapping discharge nozzles is increased, it is possible that the impact sequence of the ink drops at the transitional locations between the discharge nozzles of the rear-end portion of the head unit and the discharge nozzles of the front-end portion of the head unit is in accordance with the impact sequence of the ink drops of another color.

Moreover, the above-mentioned objects of the present invention are achieved by an image forming apparatus in which an ink jet printing device is provided, the ink jet printing device comprising: a head unit in which a plurality of recording heads having discharge nozzles which discharge ink drops of different colors respectively are arranged in a main scanning direction, and the discharge nozzles of each of the recording heads are arranged at equal intervals in a sub-scanning direction which is perpendicular to the main scanning direction; a head-unit moving unit moving the head unit in the main scanning direction along a printing region of a recording medium; a recording-medium moving unit moving the recording medium in the sub-scanning direction; and a control unit controlling the head unit, the head-unit moving unit, and the recording-medium moving unit, wherein the control unit is configured to carry out printing procedures including steps of moving the recording medium to the printing region to perform the discharging of the ink drops, and moving the recording medium in the sub-scanning direction by an interval represented by the formula H/k where H is an array interval of the discharge nozzles in the sub-scanning direction and k is an integer above one, to perform the discharging of the ink drops to a non-printed region equivalent to the array interval H of the discharge nozzles, and configured to repeat the printing procedures k times according to an ink dot density, and thereafter move the recording medium in the sub-scanning direction so that the head unit is located to a next non-printed region following the printing region and the printing procedures are performed for the next non-printed region, wherein the control unit is configured so that a rear-end portion of the discharge nozzles in an array direction after printing of the printing region and a front-end portion of the discharge nozzles in the array direction before printing of the non-printed region overlap each other with respect to the sub-scanning direction, and invalid nozzles that do not discharge the ink drops are determined from among arbitrary ones of the overlapping discharge nozzles including the front-end portion and the rear-end portion in the array direction of the discharge nozzles.

By the above composition of the image forming apparatus of the present invention, by covering the whole recording medium and maintaining the impact sequence of the ink without being reversed, and the image forming apparatus of the present invention can prevent the occurrence of color inconsistency on the recording medium and attain high-quality printing.

According to the present invention, it is possible to provide an ink jet printing device and image forming apparatus which can prevent the occurrence of color inconsistency on the recording medium, and attain high-quality printing by maintaining the impact sequence of the ink without being reversed, in the case of printing by the high resolution higher than the resolution determined according to the array interval of the discharge nozzles.

BEST MODE FOR CARRYING OUT THE INVENTION

A description will now be given of the preferred embodiments of the invention with reference to the accompanying drawings.

Referring to FIG. 1 through FIG. 7B, the ink jet printing device in the first preferred embodiment of the invention will be explained.

Figure 1:
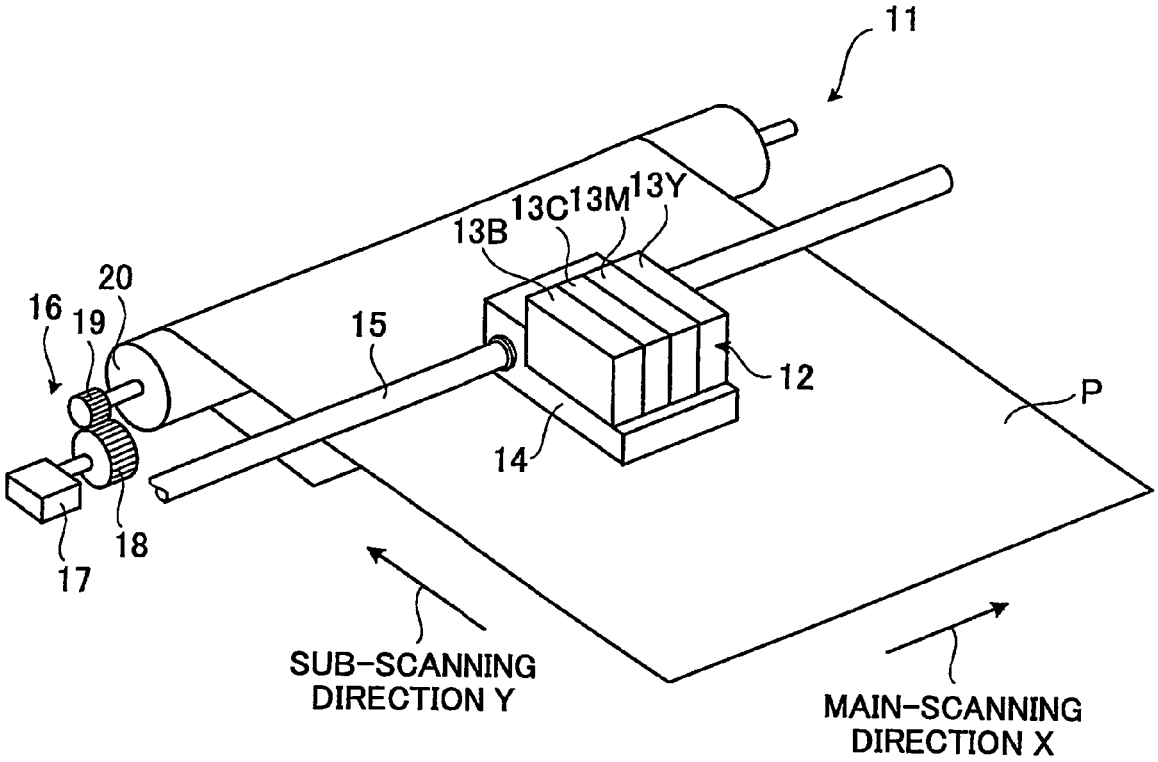
FIG. 1 is a perspective view of the ink jet printing device in the first preferred embodiment of the invention.
Figure 2:
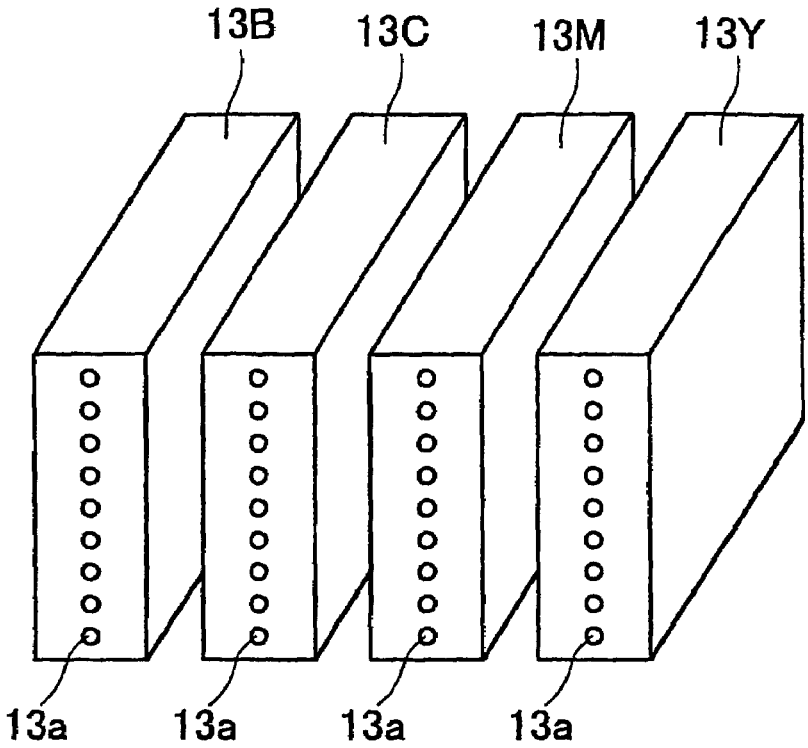
FIG. 2 is a perspective view of the head unit in the first preferred embodiment.

FIG. 1 and FIG. 2 show the composition of the ink jet printing device in the first preferred embodiment of the invention. The ink jet printing device 11 of FIG. 1 is provided in an image forming apparatus, such as a copier, a printer, a facsimile, a multi-function peripheral, etc. Since the image forming apparatus is well known in the art, the drawings showing the composition of the image forming apparatus will be omitted.

As shown in FIG. 1, the ink jet printing device 11 comprises the head unit 12. The head unit 12 includes the plurality of recording heads 13B, 13C, 13M, and 13Y which have the discharge nozzles 13*a* which discharge the ink drops of the black (B), the cyan (C), the magenta (M), and the yellow (Y), respectively, and are arranged in the main scanning direction X of the recording sheet (recording medium) P. As shown in FIG. 2, the discharge nozzles 13*a* of each of the recording heads 13B, 13C, 13M, and 13Y are arranged at equal intervals in the sub-scanning direction Y which is substantially perpendicular to the main scanning direction X.

The sequence of the discharge nozzles 13*a* may be arranged along the sub-scanning direction Y. Alternatively, it may be arranged along the slanted direction to the sub-scanning direction Y.

The head unit 12 is provided with an energy generating unit for carrying out the discharging of the ink, and the energy generating unit may be formed of any of the piezoelectric actuator, such as the piezoelectric device, the thermal actuator utilizing the phase change of the liquid by the liquid film boiling using the heat-electricity conversion elements, such as the exothermic resistor, the shape-memory alloy actuator utilizing the metal phase change due to temperature change, the electrostatic actuator utilizing the electrostatic force, etc. In the present embodiment, the head unit 12 is provided with the piezoelectric actuator (or the piezoelectric device) used as the energy generating unit, and the head unit 12 is incorporated in the ink jet printing device 12.

Moreover, the head unit 12 is carried on the carriage 14, and this carriage 14 is moved in the main scanning direction along the shaft 15 by the moving mechanism 21. The moving mechanism 21 is equipped with the motor, the reduction gear, etc. Therefore, the head unit 12 is moved in the main scanning direction by the carriage 14, and carries out the discharging of the ink to the recording sheet P. In addition, the carriage 14 and the moving mechanism 21 in the present embodiment constitute the head-unit moving unit in the claims.

Moreover, the recording sheet P is conveyed in the sub-scanning direction Y by the conveyance mechanism 16, and this conveyance mechanism 16 constitutes the recording-medium moving unit in the claims. The conveyance mechanism 16 comprises the motor 17, the gear 18 provided on the output axis of the motor 17, and the conveyance roller 20 to which the driving force of the motor 17 is transmitted through the gear 19 engaged with the gear 18.

Figure 3:
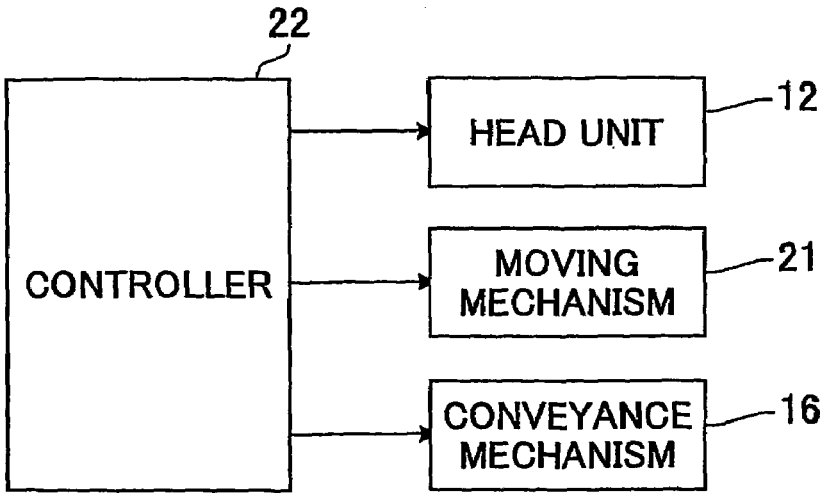
FIG. 3 is a block diagram of the control system of the ink jet printing device in the first preferred embodiment.

Moreover, the ink jet printing device 11 is controlled by the controller 22 which controls the head unit 12, the moving mechanism 21 and the conveyance mechanism 16 as shown in FIG. 3, and this controller 22 constitutes the control unit in the claims. The controller 22 comprises the CPU (central processing unit), the RAM (random access memory), the ROM (read only memory), etc. In the ink jet printing device 11 of the present embodiment, the CPU of the controller 22 performs the driving control of the carriage 14 and the conveyance mechanism 16 and performs the control of the discharging of the ink of the head unit 12 in accordance with the printing program stored in the ROM.

Moreover, assuming that the pitch (the array interval) of the discharge nozzles 13*a* in the sub-scanning direction Y is set to H, the controller 22 in the present embodiment performs the driving control of the carriage 14 and the conveyance mechanism 16 and the ink discharge control of the head unit 12, so that the ink jet printing device 11 carries out printing at a high resolution higher than the resolution determined according to the pitch H of the discharge nozzles 13*a*.

Specifically, the controller 22 in the present embodiment is configured to carry out printing procedures including steps of moving the recording sheet P to the printing region to perform the discharging of the ink drops, and moving the recording sheet P in the sub-scanning direction Y by an interval represented by the formula H/k where H is the array interval of the discharge nozzles 13*a* in the sub-scanning direction and k is an integer above one, to perform the discharging of the ink drops to a non-printed region equivalent to the array interval H of the discharge nozzles 13*a*, and configured to repeat the printing procedures k times according to the ink dot density, and thereafter move the recording sheet P in the sub-scanning direction Y so that the head unit 12 is located to a next non-printed region following the printing region and the printing procedures are performed for the next non-printed region.

Moreover, the controller 22 is configured to carry out printing so that a rear-end portion of the discharge nozzles 13*a* in an array direction after printing of the printing region and a front-end portion of the discharge nozzles 13*a* in the array direction before printing of the non-printed region overlap each other with respect to the sub-scanning direction Y, and the invalid nozzles that do not discharge the ink drops are determined from among arbitrary ones of the overlapping discharge nozzles 13*a* including the front-end portion and the rear-end portion in the array direction of the discharge nozzles 13*a*.

In addition, it should be noted that, in the present embodiment, the array direction of the discharge nozzles 13*a* of each of the recording heads of the head unit 12 is parallel to the sub-scanning direction Y as shown in FIG. 1 and FIG. 2, the rear-end portion of the discharge nozzles 13*a* in the array direction is located on the side of the bottom of the recording sheet P conveyed in the sub-scanning direction Y, and the front-end portion of the discharge nozzles 13*a* in the array direction is located on the side of the top of the recording sheet P conveyed in the sub-scanning direction Y.

Next, a description will be given of the printing procedures performed by the ink jet printing device of the present embodiment with reference to FIG. 4, FIG. 5A, FIG. 5B and FIG. 6.

Figure 5A:
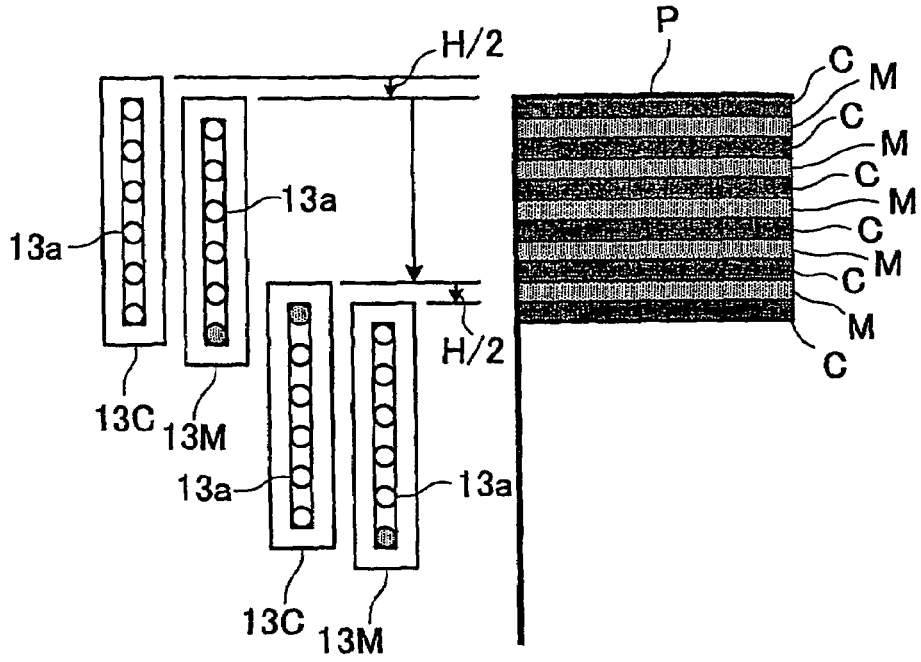
FIG. 5A and FIG. 5B are diagrams for explaining the printing procedure of the first preferred embodiment and the state of change of the recording sheet when the ink reaches the target in the printing procedure.
Figure 5B:
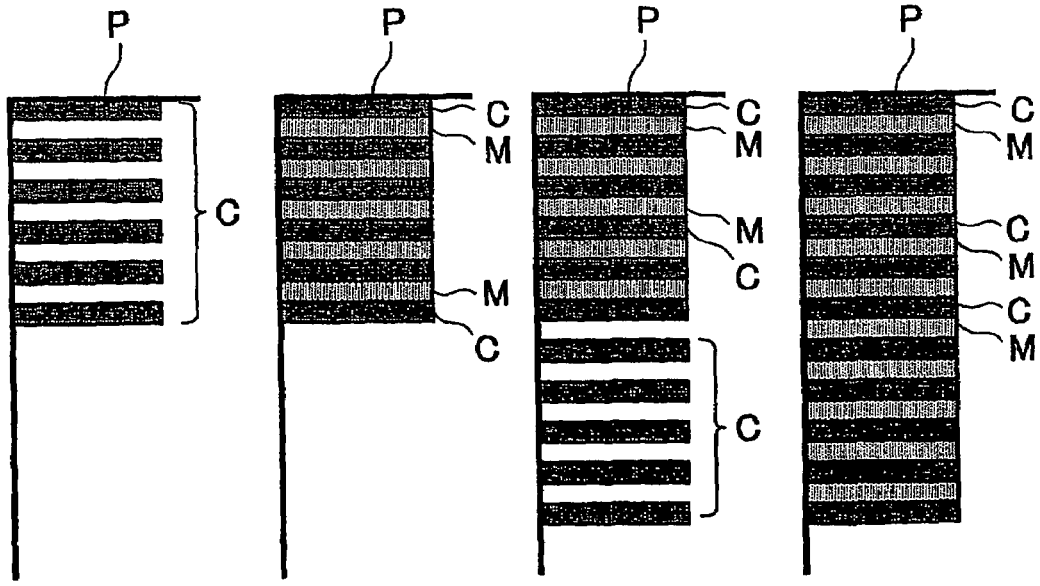
Figure 6:
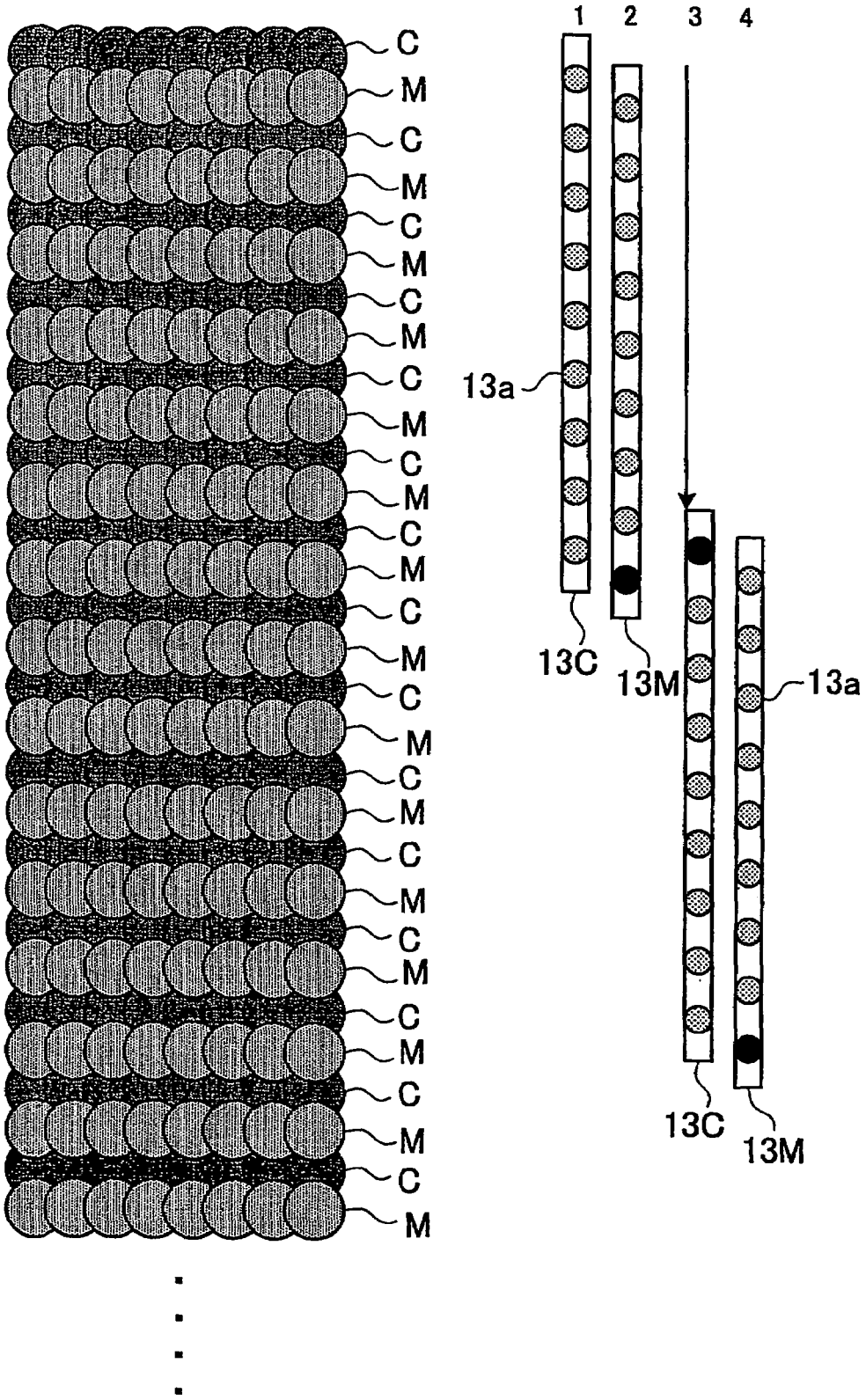
FIG. 6 is a diagram for explaining the invalid nozzles in the first preferred embodiment.

For the sake of convenience of description, in the examples of FIG. 5A, FIG. 5B and FIG. 6, it is supposed that, when the head unit 12 is moved in the main scanning direction X, the discharging of the ink drops of cyan C and magenta M of only the two colors is carried out in association with the recording heads 13C and 13M.

Moreover, it is supposed that the printing is performed by the ink jet printing device of the present embodiment at the high resolution which is twice as large as the resolution determined according to the pitch H of the discharge nozzles 13*a*, and in this case, k is set to 2 which is the base of the formula H/k representing the interval (or the pitch), and the head unit 12 is moved in the sub-scanning direction Y only twice for the same printing region.

Figure 4:
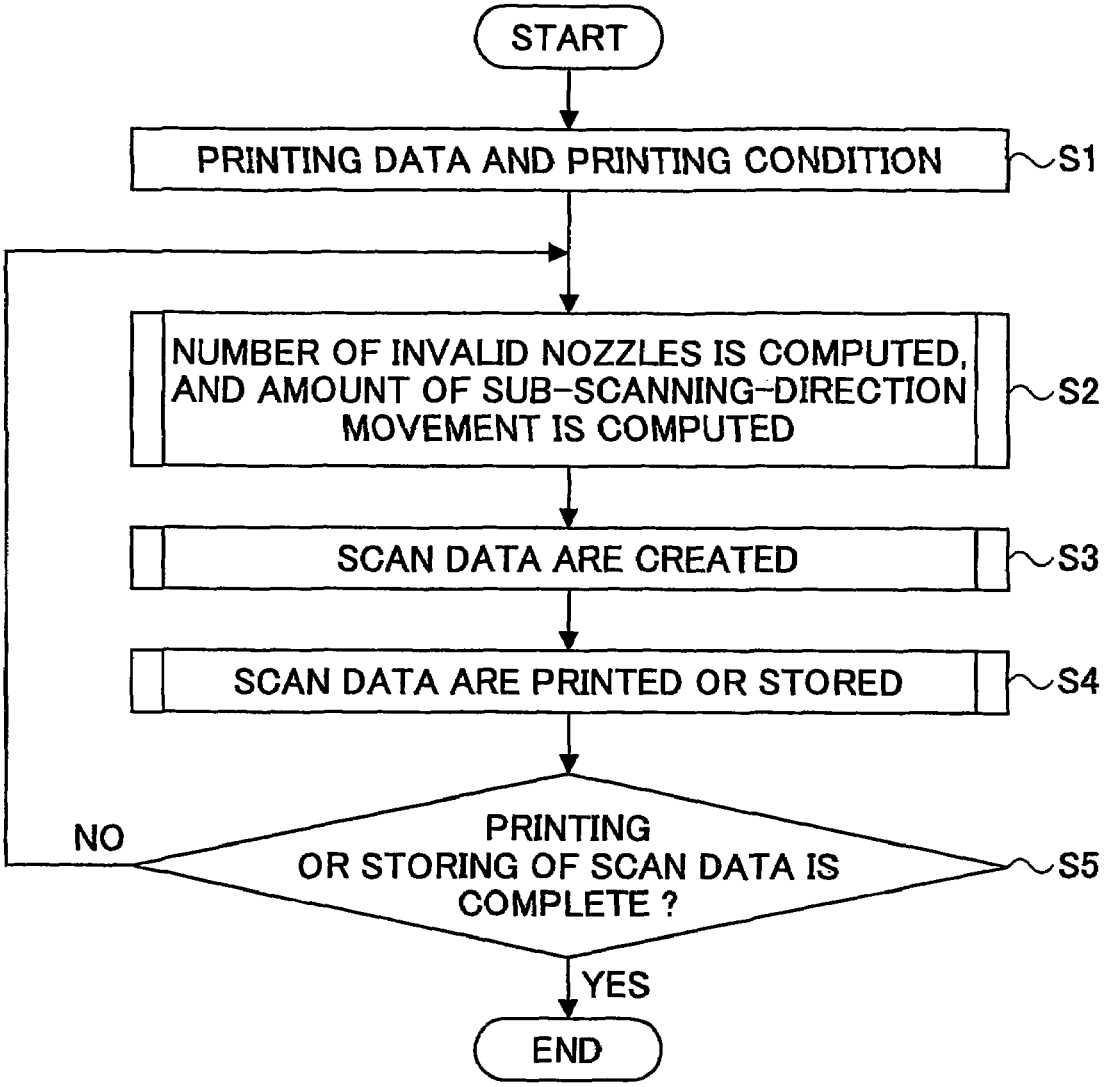
FIG. 4 is a flowchart for explaining the printing method of the ink jet printing device in the first preferred embodiment.

Upon starting of the printing procedures in the flowchart of FIG. 4, the printing data and the printing condition are set up (step S1). For example, the printing condition is set up such that the printing is performed at the high resolution which is twice as large as the resolution determined according to the pitch H of the discharge nozzles 13*a*.

Subsequently, the number of the invalid nozzles and the amount of movement of the recording sheet P in the sub-scanning direction Y are computed (step S2). After this, the scanning data for actually printing on the recording sheet P are created (step S3).

Subsequently, the head unit 12 is moved in the main scanning direction X and the discharging of the ink is carried out to perform the printing, or the processing to temporarily stores the acquired scan data in the RAM is performed (step S4).

Subsequently, it is determined whether the printing for all the printing regions of the recording sheet P is complete, or the temporary storing of all the scan data in the RAM is complete (step S5). If the result of the determination at step S5 is affirmative, then the printing procedures are finished. If the result of the determination at step S5 is negative, then the control is returned to the step S2 so that the steps S2-S5 are repeatedly performed.

A description will be given of the actual printing operations according to the flowchart of FIG. 4 with reference to FIG. 5A, FIG. 5B and FIG. 6.

In the example of FIG. 5A and FIG. 5B, the main scanning of the head unit 12 in the main scanning direction X to the same printing region of the recording sheet P is performed in the 1st time, so that the ink drops of cyan C are printed to the recording sheet P. After this, the recording sheet P is moved in the sub-scanning direction Y by the interval H/2 by the conveyance mechanism 16, and the main scanning of the head unit 12 in the main scanning direction X to the same printing region of the recording sheet P is performed in the 2nd time, so that the ink drops of magenta M are printed to the non-printed region between cyan C and cyan C.

Subsequently, the recording sheet P is conveyed in the sub-scanning direction Y by the conveyance mechanism 16, so that the head unit 12 is located to a next non-printed region of the recording sheet P.

The main scanning of the head unit 12 in the main scanning direction X to the non-printed region of the recording sheet P is performed in the 3rd time so that the ink drops of cyan C are printed to the non-printed region. After this, the recording sheet P is moved in the sub-scanning direction Y by the interval H/2.

Subsequently, the main scanning of the head unit 12 to the non-printed region of the recording sheet P is carried out in the 4th time, so that the ink drops of magenta M are printed to the non-printed region between cyan C and cyan C. The above procedures are repeated for all over the recording sheet P.

As shown in FIG. 5A, when performing the 3rd main scanning after the 2nd main scanning is completed, the position of the rear-end portion of the discharge nozzles 13*a* of the recording head 13C in the array direction for the 1st main scanning and the position of the front-end portion of the discharge nozzles 13*a* of the recording head 13C in the array direction for the 3rd main scanning overlap with each other with respect to the sub-scanning direction.

Moreover, when performing the 4th main scanning, the position of the rear-end portion of the discharge nozzles 13*a* of the recording head 13C in the array direction for the 2nd main scanning and the position of the front-end portion of the discharge nozzles 13*a* of the recording head 13C in the array direction for the 4th main scanning overlap with each other with respect to the sub-scanning direction.

At this time, the controller 22 determines, as being the invalid nozzles which do not discharge the ink, the discharge nozzle 13*a* (the filled-in portion) at the rear-end portion of the recording head 13M in the array direction for the 2nd main scanning, the discharge nozzle 13*a* (the filled-in portion) at the front-end portion of the recording head 13C in the array direction for the 3rd main scanning, and the discharge nozzle 13*a* (the filled-in portion) at the rear-end portion of the recording head 13M in the array direction for 4th main scanning, as shown in FIG. 6.

Namely, the invalid nozzles determined by the controller 22 at this time are the discharge nozzle 13*a* of the array direction rear-end portion for the final main scanning which is performed in the same printing region, and the discharge nozzle 13*a* of the array direction front-end portion for the first main scanning which is performed in the non-printed region. These invalid nozzles are selected from among the overlapping discharge nozzles 13*a* including the discharge nozzles 13*a* of the array direction front-end portion and the array direction rear-end portion.

Consequently, the ink drops can reach the target locations on the recording sheet P in order of cyan C and magenta M in the state where magenta M overlaps on cyan C. Thus, it is possible for the present embodiment to prevent the occurrence of color inconsistency on the recording sheet P and attain high-quality printing at the high resolution without reversing the impact sequence of the ink.

Figure 7A:
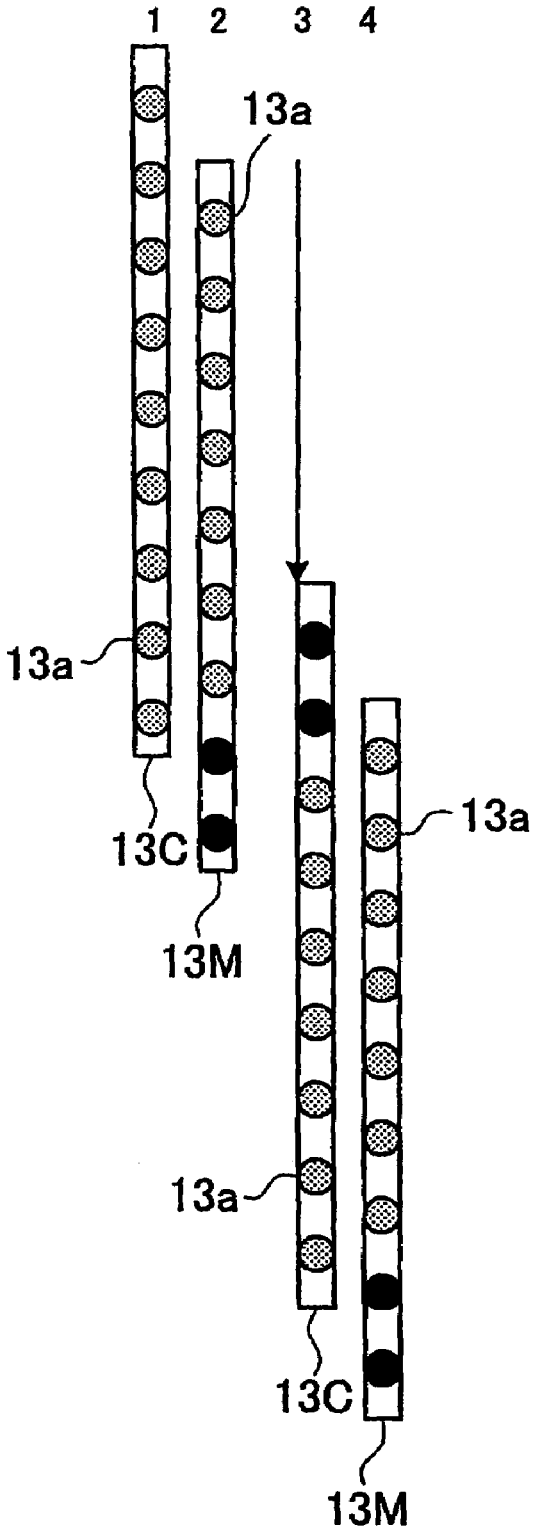
FIG. 7A and FIG. 7B are diagrams for explaining the invalid nozzles in the first preferred embodiment when printing at another resolution.
Figure 7B:
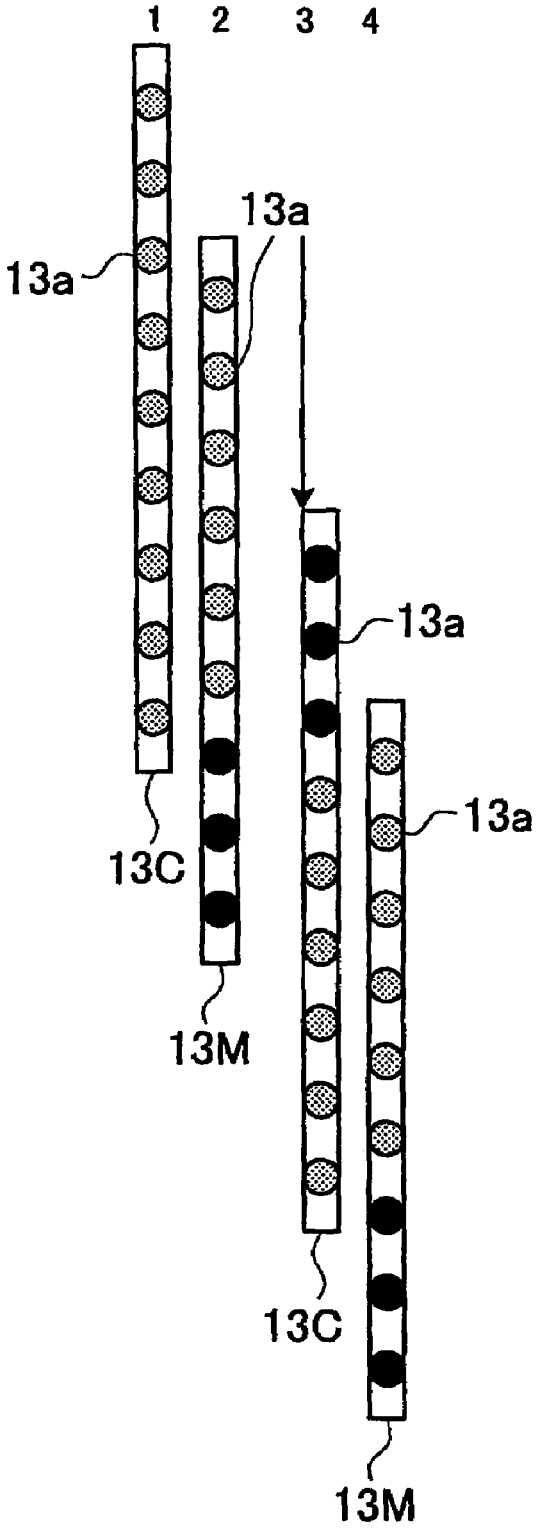

FIG. 7A shows the case in which two discharge nozzles at the rear-end portion of the discharge nozzles 13*a* in the array direction and two discharge nozzles at the front-end portion of the discharge nozzles 13*a* in the array direction, which overlap with each other with respect to the sub-scanning direction, are determined as being the invalid nozzles. FIG. 7B shows the case in which three discharge nozzles at the rear-end portion of the discharge nozzles 13*a* in the array direction and three discharge nozzles at the front-end portion of the discharge nozzles 13*a* in the array direction, which overlap with each other with respect to the sub-scanning direction, are determined as being the invalid nozzles.

In the cases of FIG. 7A and FIG. 7B, the invalid nozzles determined by the controller 22 are the two or three discharge nozzles 13*a* (the filled-in portions) at the rear-end portion of the recording head 13M in the array direction for the 2nd main scanning, the two or three discharge nozzles 13*a* (the filled-in portions) at the front-end portion of the recording head 13C in the array direction for the 3rd main scanning, and the two or three discharge nozzles 13*a* (the filled-in portions) at the rear-end portion of the recording head 13M in the array direction for the 4th main scanning.

Namely, when the number of the overlapping discharge nozzles is increased, the controller 22 is provided to increase the number of the invalid nozzles determined.

Also, in the present embodiment, the ink drops can reach the target locations on the recording sheet P in order of cyan C and magenta M in the state where magenta M overlaps on cyan C. Thus, it is possible for the present embodiment to prevent the occurrence of color inconsistency on the recording sheet P and attain high-quality printing at the high resolution without reversing the impact sequence of the ink.

Figure 8:
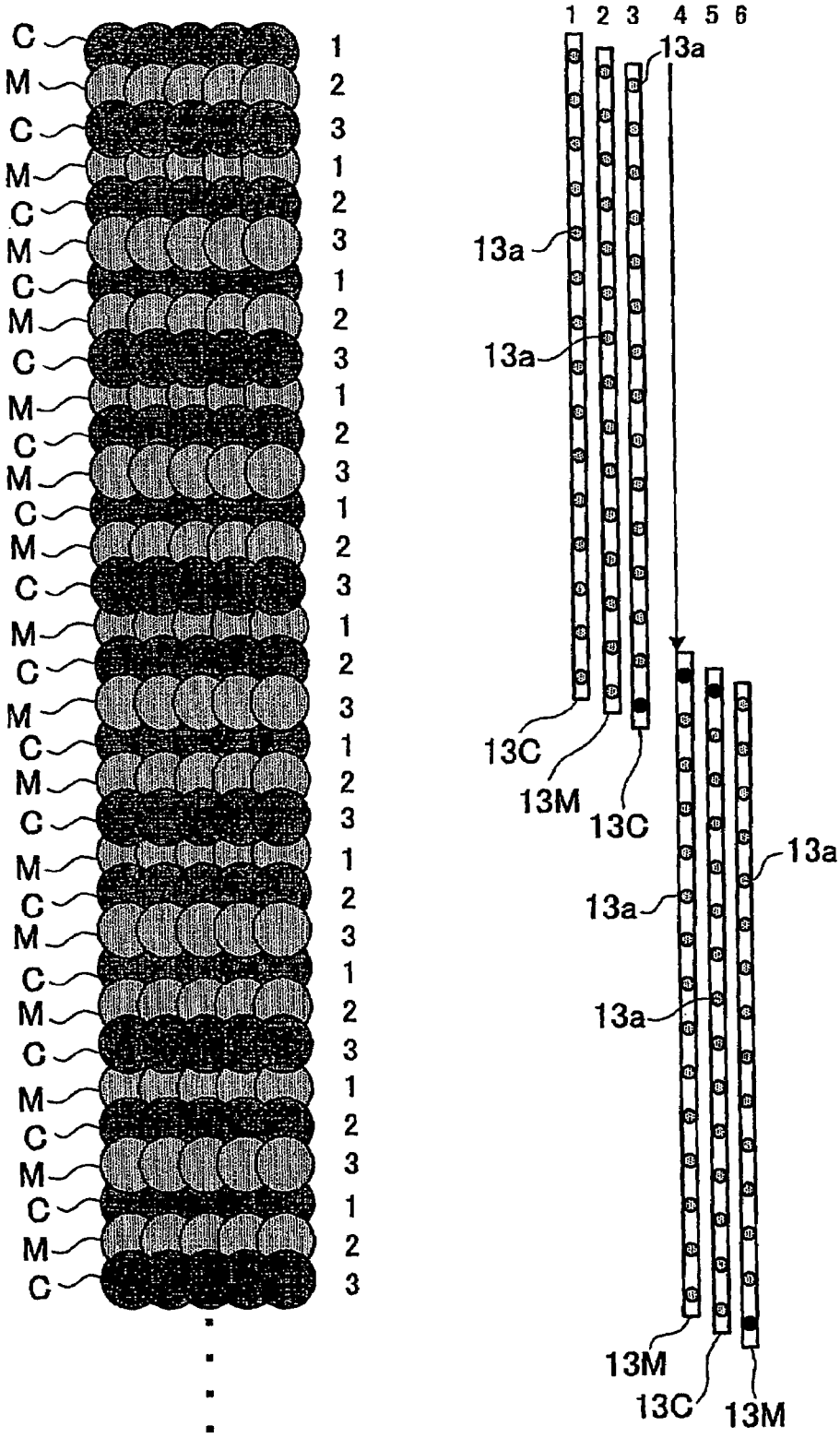
FIG. 8 is a diagram for explaining the invalid nozzles of the ink jet printing device in the second preferred embodiment of the invention.
Figure 9A:
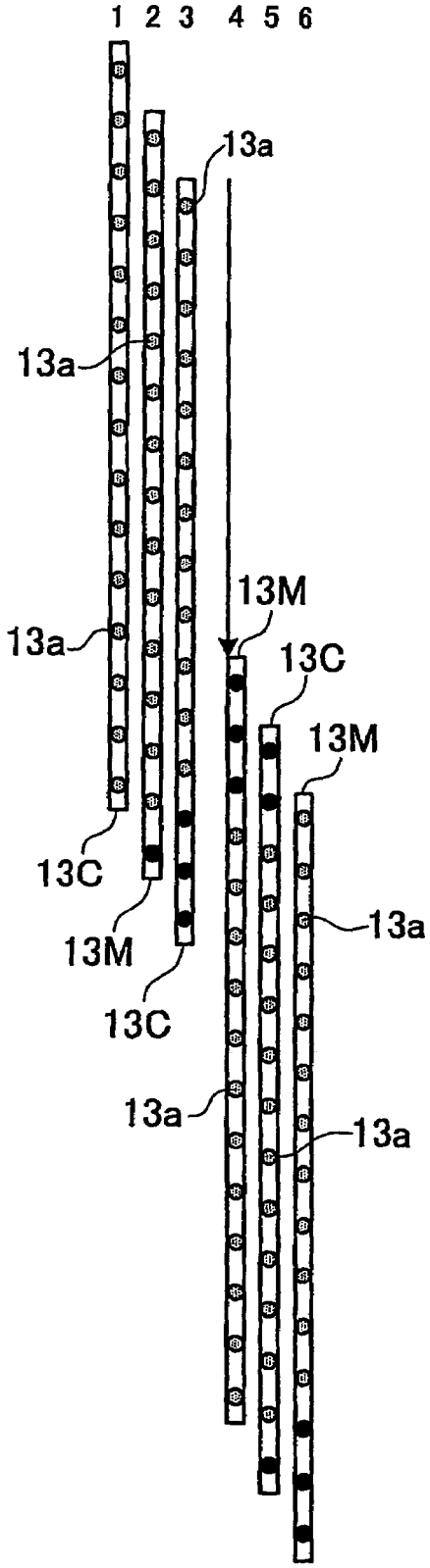
FIG. 9A and FIG. 9B are diagrams for explaining the invalid nozzles in the second preferred embodiment when printing at another resolution.
Figure 9B:
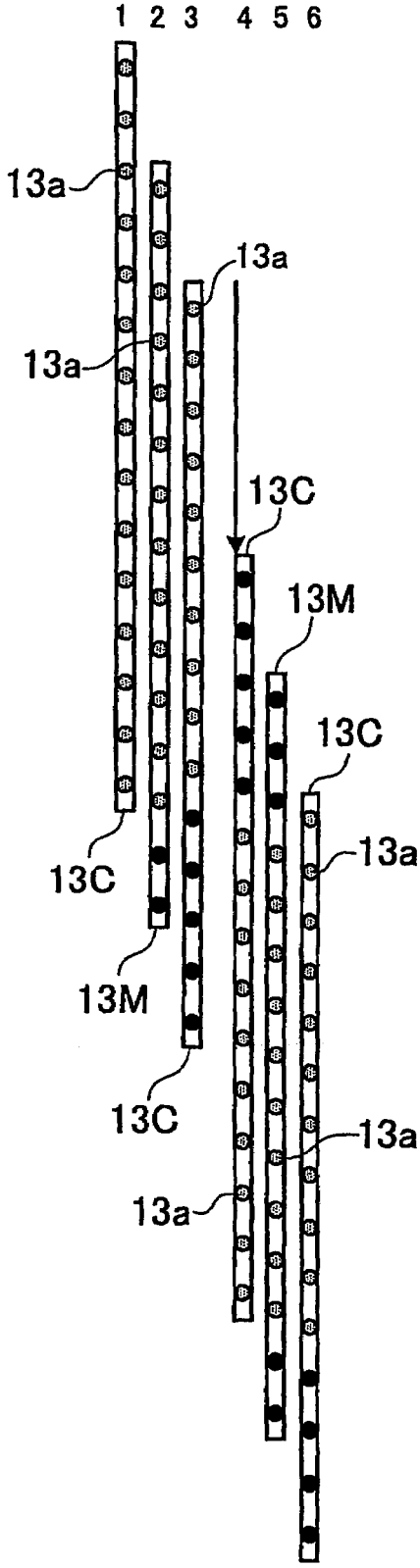

Next, FIG. 8, FIG. 9A and FIG. 9B are diagrams for explaining the invalid nozzles of the ink jet printing device in the 2nd preferred embodiment of the invention. The ink jet printing device of the present embodiment is characterized in that the high resolution of the printing performed by the ink jet printing device and the positions of the invalid nozzles determined by the ink jet printing device differ from the first preferred embodiment. The composition of the ink jet printing device 11 of the present embodiment is essentially the same as that of the first preferred embodiment, and a description thereof will be omitted.

Similar to the first preferred embodiment, it is supposed that, in the present embodiment, when the head unit 12 is moved in the main scanning direction X, the discharging of the ink drops of cyan C and magenta M of only the two colors is carried out in association with the recording heads 13C and 13M, for the sake of convenience of description.

Moreover, it is also supposed that the printing is performed by the ink jet printing device of the present embodiment at the high resolution which is 3 times as large as the resolution determined according to the pitch H of the discharge nozzles 13*a*, and in this case, k is set to 3 which is the base of the formula H/k representing the interval (or the pitch), and the head unit 12 is moved in the sub-scanning direction Y only 3 times for the same printing region.

In the example of FIG. 8, the main scanning of the head unit 12 in the main scanning direction X to the same printing region of the recording sheet P is performed in the 1st time, so that the ink drops of cyan C are printed to the recording sheet P. After this, the recording sheet P is moved in the sub-scanning direction Y by the interval H/3, and the main scanning of the head unit 12 to the same printing region of the recording sheet P is performed in the 2nd time, so that the ink drops of magenta M are printed to the non-printed region between cyan C and cyan C.

After this, the recording sheet P is moved in the sub-scanning direction Y by the interval H/3, and the main scanning of the head unit 12 to the same printing region of the recording sheet P is performed in the 3rd time, so that the ink drops of cyan C are printed to the non-printed region between magenta M and magenta M.

Subsequently, the recording sheet P is conveyed in the sub-scanning direction Y by the conveyance mechanism 16, so that the head unit 12 is located to a next non-printed region of the recording sheet P.

After this, the main scanning of the head unit 12 in the main scanning direction X to the non-printed region of the recording sheet P is performed in the 4th time, so that the ink drops of magenta M are printed to the recording sheet P. After this, the recording sheet P is moved in the sub-scanning direction Y by the interval H/3, and the main scanning of the head unit 12 in the main scanning direction X to the non-printed region of the recording sheet P is performed in the 5th time, so that the ink drops of cyan C are printed to the non-printed region between magenta M and magenta M.

Subsequently, the recording sheet P is moved in the sub-scanning direction Y by the interval H/3, and the main scanning of the head unit 12 in the main scanning direction X to the non-printed region of the recording sheet P is performed in the 6th time, so that the ink drops of magenta M are printed to the non-printed region between cyan C and cyan C. The above procedures are repeated for all over the recording sheet P.

As shown in FIG. 8, when performing the 4th main scanning after the 3rd main scanning is completed, the position of the rear-end portion of the discharge nozzles 13*a* of the recording head 13C in the array direction for the 1st main scanning and the position of the front-end portion of the discharge nozzles 13*a* of the recording head 13M in the array direction for the 4th main scanning overlap with each other with respect to the sub-scanning direction Y.

Moreover, when performing the 5th main scanning, the position of the rear-end portion of the discharge nozzles 13*a* of the recording head 13M in the array direction for the 2nd main scanning and the position of the front-end portion of the discharge nozzles 13*a* of the recording head 13C in the array direction for the 5th main scanning overlap with each other with respect to the sub-scanning direction Y.

Moreover, when performing the 6th main scanning, the position of the rear-end portion of the discharge nozzles 13*a* of the recording head 13C in the array direction for the 3rd main scanning and the position of the front-end portion of the discharge nozzles 13*a* of the recording head 13M in the array direction for the 6th main scanning overlap with each other with respect to the sub-scanning direction Y.

At this time, the controller 22 determines, as being the invalid nozzles, the discharge nozzle 13*a* (the filled-in portion) at the array direction rear-end portion of the recording head 13C for the 3rd main scanning, the discharge nozzle 13*a* (the filled-in portion) at the array direction front-end portion of the recording head 13M for the 4th main scanning, the discharge nozzle 13*a* (the filled-in portion) at the array direction front-end portion of the recording head 13C for the 5th main scanning, and the discharge nozzle 13*a* (the filled-in portion) at the array direction rear-end portion of the recording head 13M for the 6th main scanning.

In this manner, the number k of repetitions of the movement of the recording sheet P increases when the recording sheet P is moved in the sub-scanning direction by the interval H/3. Namely, the resolution of the printing performed by the ink jet printing device of the present embodiment is increased three times. The invalid nozzles determined by the ink jet printing device of the present embodiment when the resolution is increased three times are the discharge nozzles 13*a* at the array direction front-end portion of the overlapping discharge nozzles 13*a* when repeatedly moved in the main scanning direction X for the non-printed region except for the final main scanning. These invalid nozzles are selected from among the overlapping discharge nozzles 13*a* including the discharge nozzles 13*a* of the array direction front-end portion and the array direction rear-end portion.

Consequently, the ink drops can reach the target locations on the recording sheet P in order of cyan C and magenta M in the state where magenta M overlaps on cyan C. Thus, it is possible for the present embodiment to prevent the occurrence of color inconsistency on the recording sheet P and attain high-quality printing at the high resolution without reversing the impact sequence of the ink.

Moreover, FIG. 9A shows the case in which three discharge nozzles at the rear-end portion of the discharge nozzles 13*a* in the array direction and three discharge nozzles at the front-end portion of the discharge nozzles 13*a* in the array direction, which overlap with each other with respect to the sub-scanning direction Y, are determined as being the invalid nozzles. FIG. 9B shows the case in which five discharge nozzles at the rear-end portion of the discharge nozzles 13*a* in the array direction and five discharge nozzles at the front-end portion of the discharge nozzles 13*a* in the array direction, which overlap with each other with respect to the sub-scanning direction Y, are determined as being the invalid nozzles.

Specifically, in the cases of FIG. 9A and FIG. 9B, the invalid nozzles determined by the controller 22 are the one or two discharge nozzles 13*a* (the filled-in portions) at the array direction read-end portion of the recording head 13M for the 2nd main scanning, the three or five discharge nozzles 13*a* (the filled-in portions) at the array direction rear-end portion of the recording head 13C for the 3rd main scanning, the three or five discharge nozzles 13*a* (the filled-in portions) at the array direction front-end portion of the recording head 13M for the 4th main scanning, the two or three discharge nozzles 13*a* (the filled-in portions) at the array direction front-end portion of the recording head 13C for the 5th main scanning, the one or two discharge nozzles 13*a* (the filled-in portions) at the array direction rear-end portion of the recording head 13C for the 5th main scanning, and the three or five discharge nozzles 13*a* (the filled-in portion) at the array direction rear-end portion of the recording head 13M for the 6th main scanning.

Consequently, the ink drops can reach the target locations on the recording sheet P in order of cyan C and magenta M in the state where magenta M overlaps on cyan C. Thus, it is possible for the present embodiment to prevent the occurrence of color inconsistency on the recording sheet P and attain high-quality printing at the high resolution without reversing the impact sequence of the ink.

Figure 10:
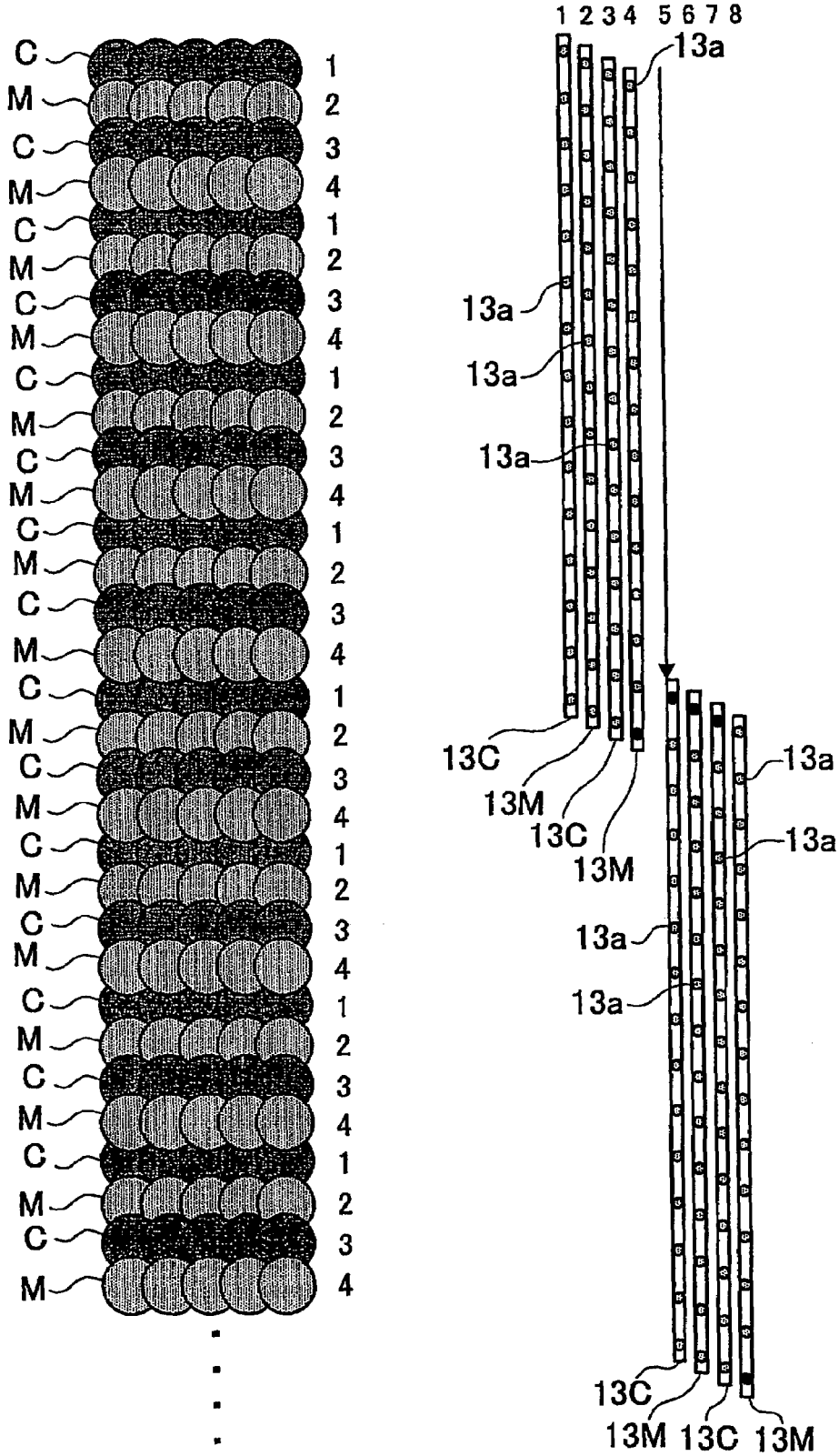
FIG. 10 is a diagram for explaining the invalid nozzles of the ink jet printing device in the third preferred embodiment of the invention.

Next, FIG. 10 and FIG. 11 are diagrams for explaining the invalid nozzles of the ink jet printing device in the third preferred embodiment of the invention. The ink jet printing device of the present embodiment is characterized in that the high resolution of the printing performed by the ink jet printing device and the positions of the invalid nozzles determined by the ink jet printing device differ from the first preferred embodiment. The composition of the ink jet printing device 11 of the present embodiment is essentially the same as that of the first preferred embodiment, and a description thereof will be omitted.

Similar to the first preferred embodiment, it is supposed that, in the present embodiment, when the head unit 12 is moved in the main scanning direction X, the discharging of the ink drops of cyan C and magenta M of only the two colors is carried out in association with the recording heads 13C and 13M, for the sake of convenience of description.

Moreover, it is also supposed that the printing is performed by the ink jet printing device of the present embodiment at the high resolution which is 4 times as large as the resolution determined according to the pitch H of the discharge nozzles 13*a*, and in this case, k is set to 4 which is the base of the formula H/k representing the interval (or the pitch), and the head unit 12 is moved in the sub-scanning direction Y only 4 times for the same printing region.

In the example of FIG. 10, the main scanning of the head unit 12 in the main scanning direction X to the same printing region of the recording sheet P is performed in the 1st time, so that the ink drops of cyan C are printed to the recording sheet P. After this, the recording sheet P is moved in the sub-scanning direction Y by the interval H/4, and the main scanning of the head unit 12 to the same printing region of the recording sheet P is performed in the 2nd time, so that the ink drops of magenta M are printed to the non-printed region between cyan C and cyan C.

After this, the recording sheet P is moved in the sub-scanning direction Y by the interval H/4, and the main scanning of the head unit 12 to the same printing region of the recording sheet P is performed in the 3rd time, so that the ink drops of cyan C are printed to the non-printed region between magenta M and magenta M. After this, the recording sheet P is moved in the sub-scanning direction Y by the interval H/4, and the main scanning of the head unit 12 to the same printing region of the recording sheet P is performed in the 4th time, so that the ink drops of magenta M are printed to the non-printed region between cyan C and cyan C.

Subsequently, the recording sheet P is conveyed in the sub-scanning direction Y by the conveyance mechanism 16, so that the head unit 12 is located to a next non-printed region of the recording sheet P.

After this, the main scanning of the head unit 12 in the main scanning direction X to the non-printed region of the recording sheet P is performed in the 5th time, so that the ink drops of cyan C are printed to the recording sheet P. After this, the recording sheet P is moved in the sub-scanning direction Y by the interval H/4, and the main scanning of the head unit 12 in the main scanning direction X to the non-printed region of the recording sheet P is performed in the 6th time, so that the ink drops of magenta M are printed to the non-printed region between cyan C and cyan C.

Subsequently, the recording sheet P is moved in the sub-scanning direction Y by the interval H/4, and the main scanning of the head unit 12 in the main scanning direction X to the non-printed region of the recording sheet P is performed in the 7th time, so that the ink drops of cyan C are printed to the non-printed region between magenta M and magenta M.

After this, the recording sheet P is moved in the sub-scanning direction Y by the interval H/4, and the main scanning of the head unit 12 to the same printing region of the recording sheet P is performed in the 8th time, so that the ink drops of magenta M are printed to the non-printed region between cyan C and cyan C. The above procedures are repeated for all over the recording sheet P.

As shown in FIG. 10, when performing the 5th main scanning after the 4th main scanning is completed, the position of the rear-end portion of the discharge nozzles 13*a* of the recording head 13C in the array direction for the 1st main scanning and the position of the front-end portion of the discharge nozzles 13*a* of the recording head 13C in the array direction for the 5th main scanning overlap with each other with respect to the sub-scanning direction Y.

Moreover, when performing the 6th main scanning, the position of the rear-end portion of the discharge nozzles 13*a* of the recording head 13M in the array direction for the 2nd main scanning and the position of the front-end portion of the discharge nozzles 13*a* of the recording head 13M in the array direction for the 6th main scanning overlap with each other with respect to the sub-scanning direction Y.

Moreover, when performing the 7th main scanning, the position of the rear-end portion of the discharge nozzles 13*a* of the recording head 13C in the array direction for the 3rd main scanning and the position of the front-end portion of the discharge nozzles 13*a* of the recording head 13C in the array direction for the 7th main scanning overlap with each other with respect to the sub-scanning direction Y.

Moreover, when performing the 8th main scanning, the position of the rear-end portion of the discharge nozzles 13*a* of the recording head 13M in the array direction for the 4th main scanning and the position of the front-end portion of the discharge nozzles 13*a* of the recording head 13M in the array direction for the 8th main scanning overlap with each other with respect to the sub-scanning direction Y.

At this time, the controller 22 determines, as being the invalid nozzles, the discharge nozzle 13*a* (the filled-in portion) at the array direction rear-end portion of the recording head 13M for the 4th main scanning, the discharge nozzle 13*a* (the filled-in portion) at the array direction front-end portion of the recording head 13C for the 5th main scanning, the discharge nozzle 13*a* (the filled-in portion) at the array direction front-end portion of the recording head 13M for the 6th main scanning, the discharge nozzle 13*a* (the filled-in portion) at the array direction front-end portion of the recording head 13C for the 7th main scanning, and the discharge nozzle 13*a* (the filled-in portion) at the array direction rear-end portion of the recording head 13M for the 8th main scanning.

In this manner, the number k of repetitions of the movement of the recording sheet P increases when the recording sheet P is moved in the sub-scanning direction by the interval H/4. Namely, the resolution of the printing performed by the ink jet printing device of the present embodiment is increased four times. The invalid nozzles determined by the ink jet printing device of the present embodiment when the resolution is increased four times are the discharge nozzles 13*a* at the array direction front-end portion of the overlapping discharge nozzles 13*a* when repeatedly moved in the main scanning direction X for the non-printed region except for the final main scanning. These invalid nozzles are selected from among the overlapping discharge nozzles 13*a* including the discharge nozzles 13*a* of the array direction front-end portion and the array direction rear-end portion.

Consequently, the ink drops can reach the target locations on the recording sheet P in order of cyan C and magenta M in the state where magenta M overlaps on cyan C. Thus, it is possible for the present embodiment to prevent the occurrence of color inconsistency on the recording sheet P and attain high-quality printing at the high resolution without reversing the impact sequence of the ink.

Figure 11A:
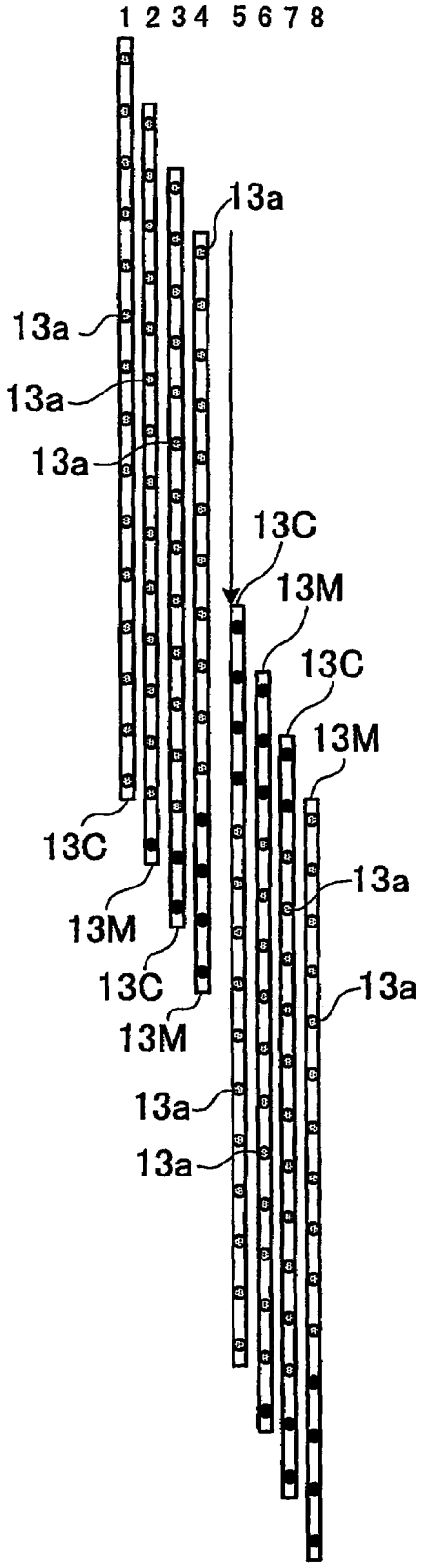
FIG. 11A and FIG. 11B are diagrams for explaining the invalid nozzles in the third preferred embodiment when printing at another resolution.
Figure 11B:
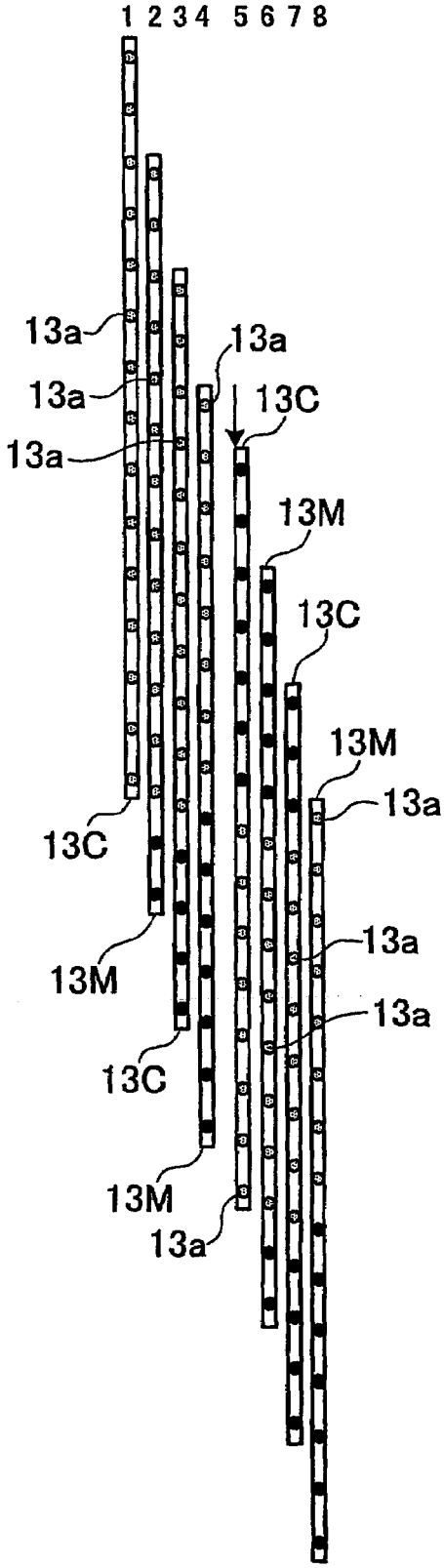
Figure 12:
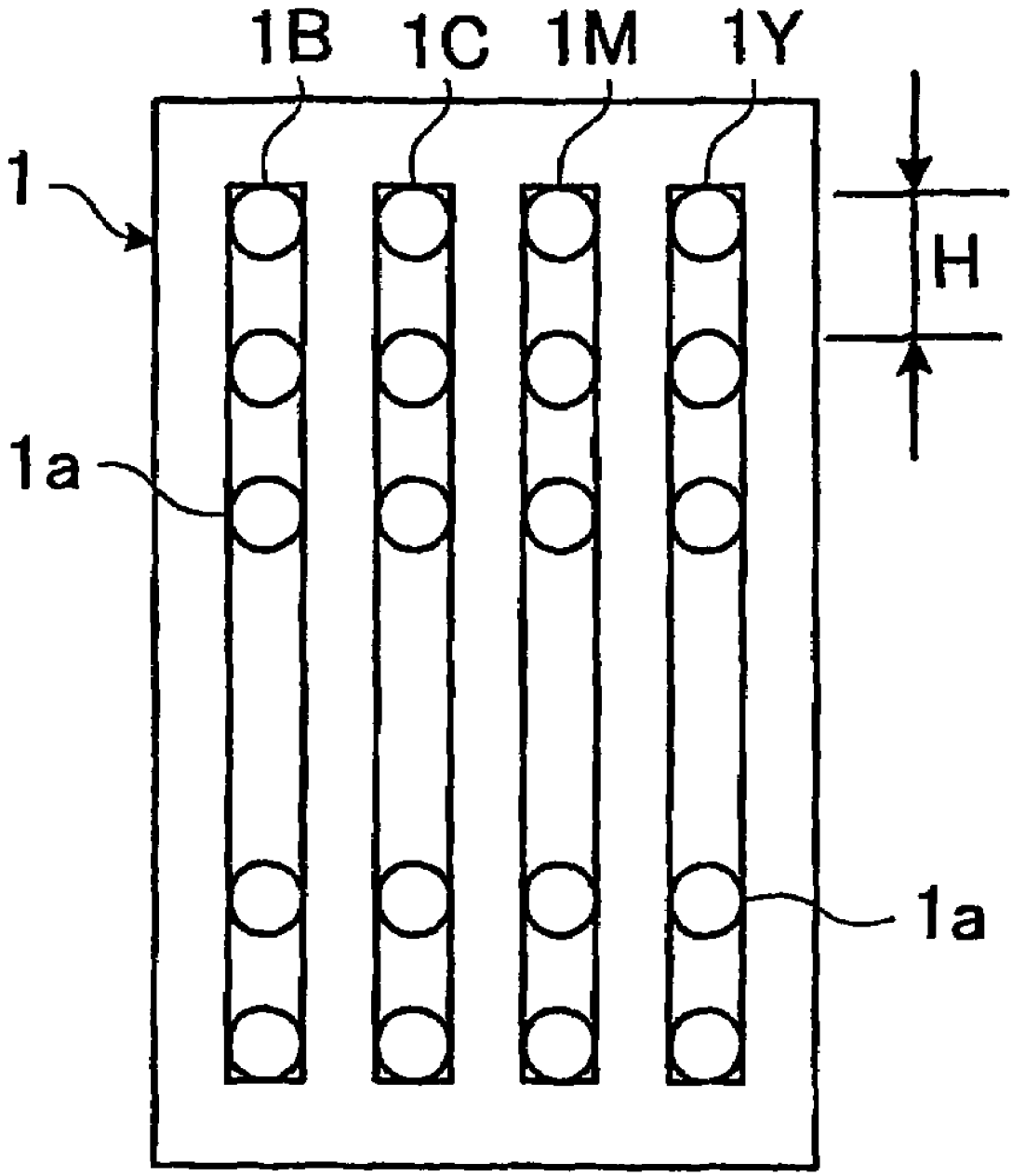
FIG. 12 is a diagram showing the composition of a conventional head unit.
Figure 13A:
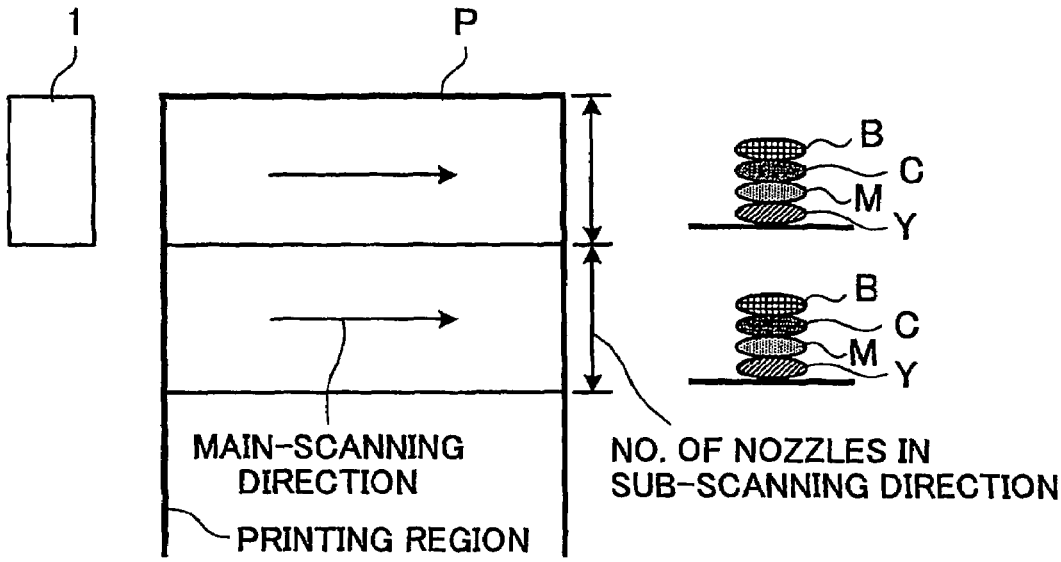
FIG. 13A and FIG. 13B are diagrams for explaining the way of printing when the head unit is scanned only in the forward main scanning direction, and the printing state of the recording sheet when the head unit is scanned only in the forward main scanning direction.
Figure 13B:
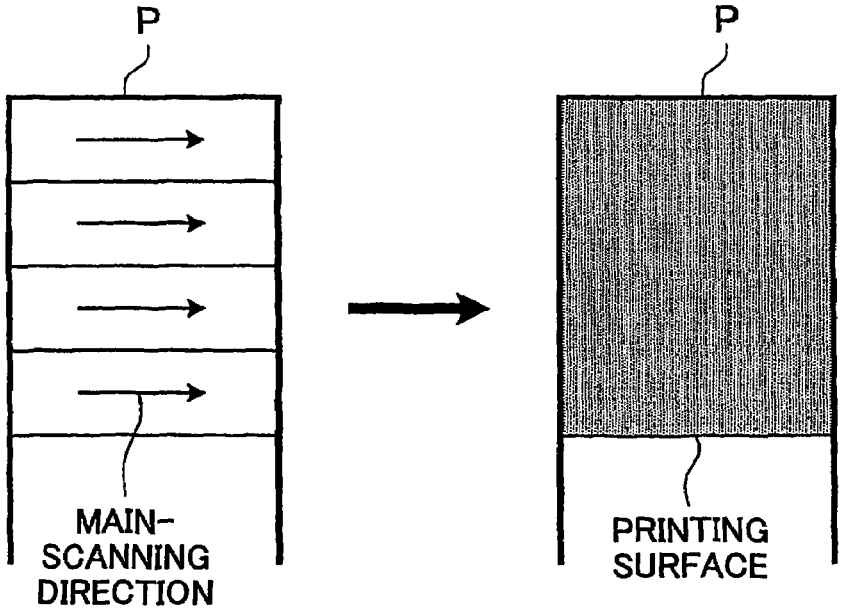
Figure 14A:
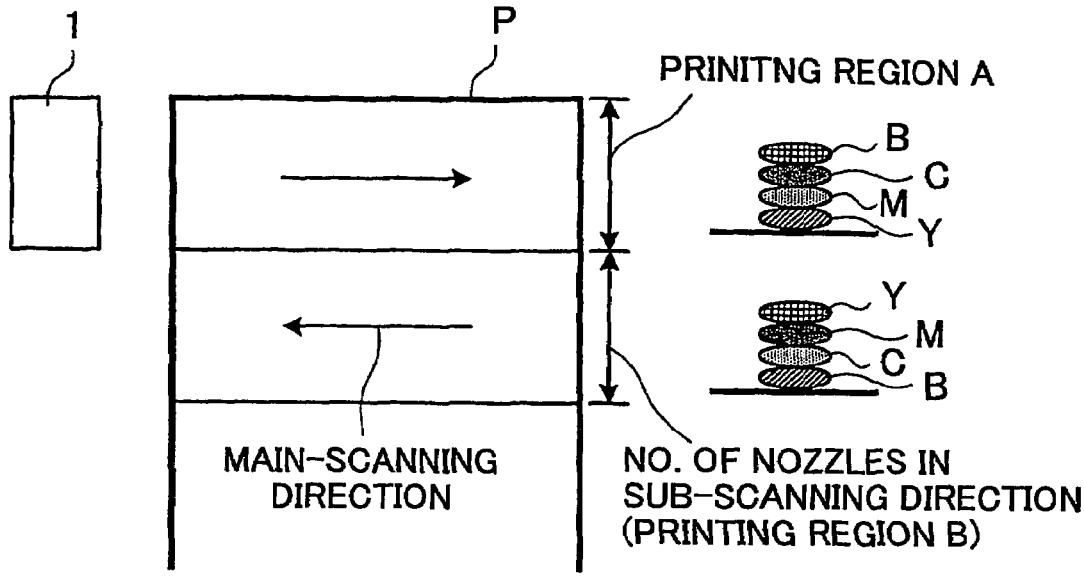
FIG. 14A and FIG. 14B are diagrams for explaining the way of printing when the head unit is scanned in the forward and backward main scanning directions alternately, and the printing state of the recording sheet when the head unit is scanned in the forward and backward main scanning directions alternately.
Figure 14B:
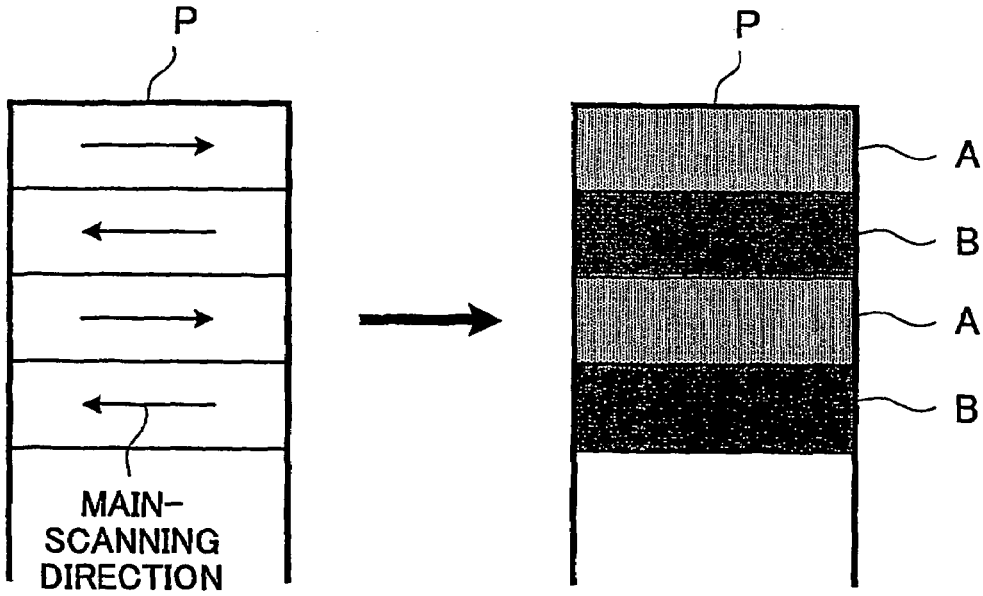
Figure 15A:
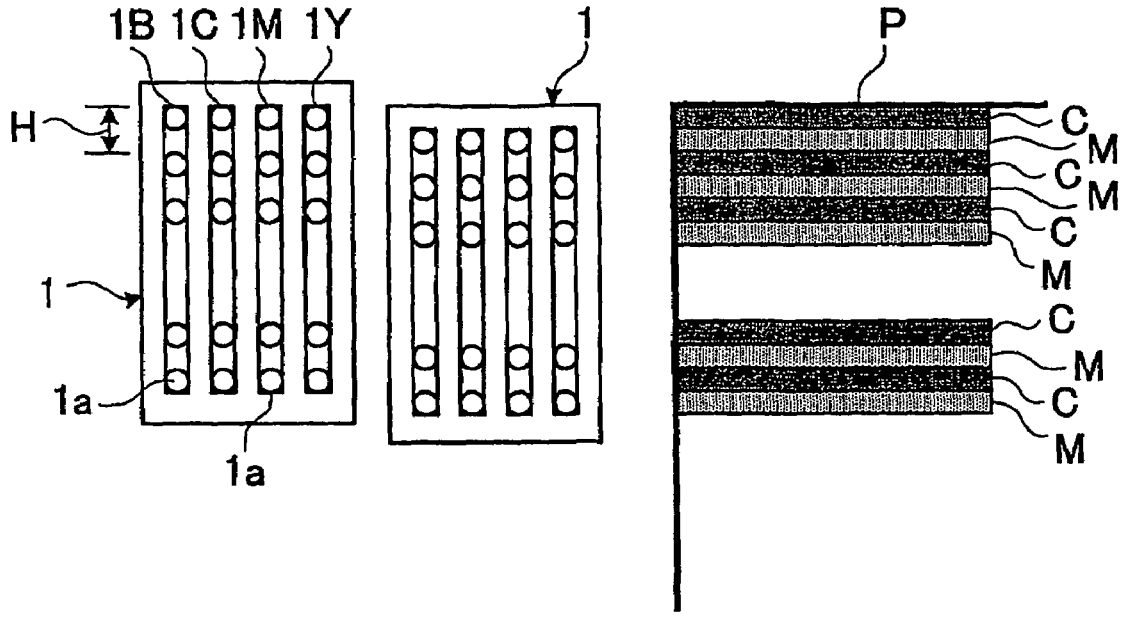
FIG. 15A and FIG. 15B are diagrams for explaining the state of printing by shifting the head unit by half the pitch of the discharge nozzles, and the printing state of the recording sheet where the ink reached.
Figure 15B:
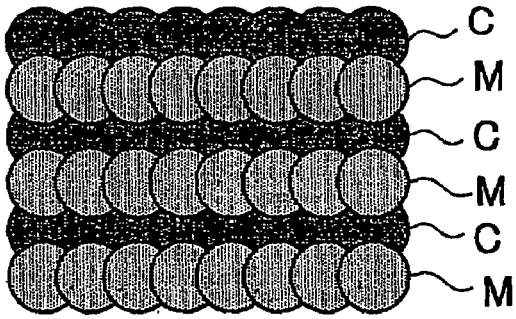
Figure 16:
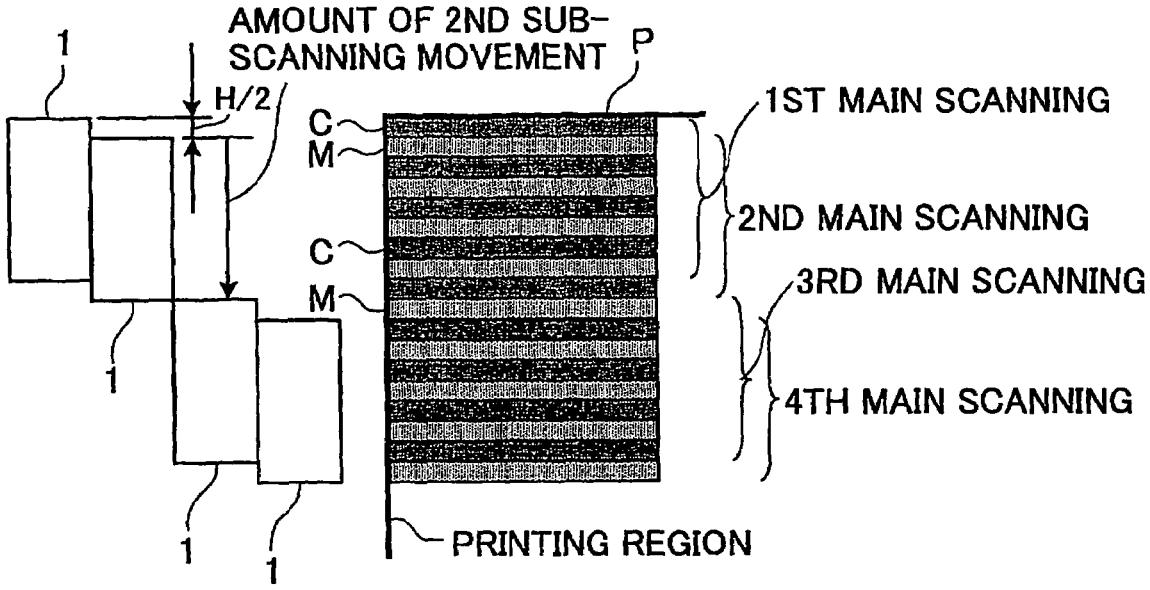
FIG. 16 is a diagram for explaining the scanning procedure of the head unit and the recording sheet when the printing is performed by shifting the head unit by half the pitch of the discharge nozzles.
Figure 17A:
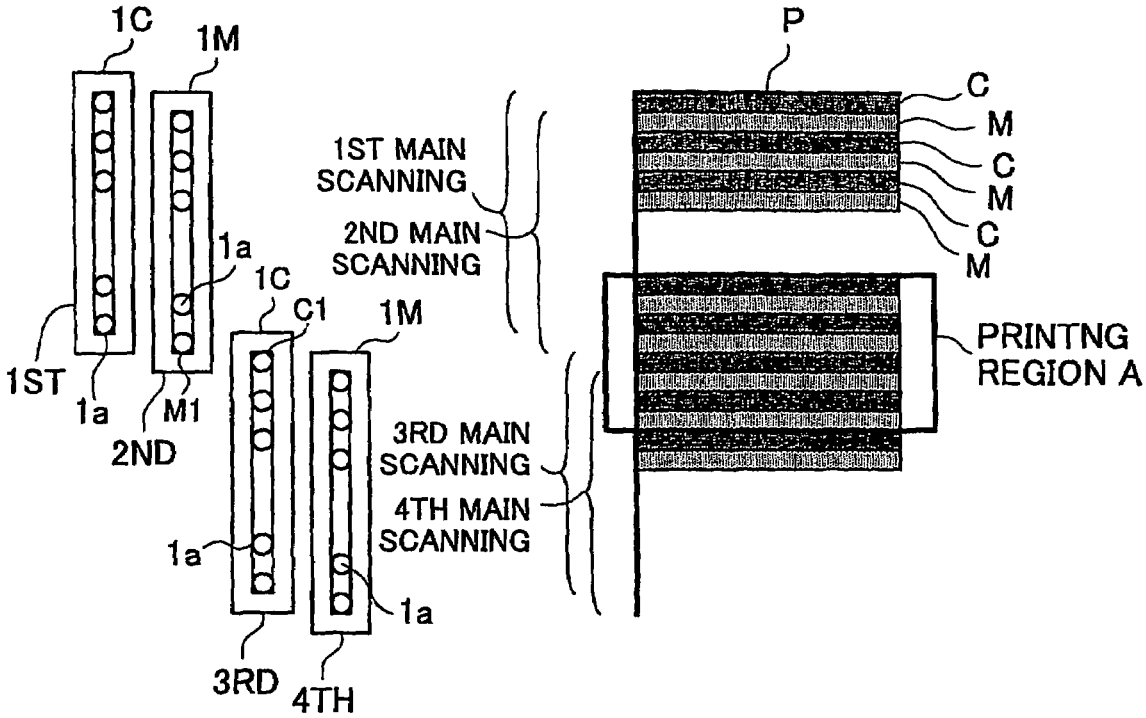
FIG. 17A and FIG. 17B are diagrams for explaining the printing state of the recording sheet when shifting the head unit by half the pitch of the discharge nozzles, and the reversing of the impact sequence of the ink in the printing region A of the recording sheet.
Figure 17B:
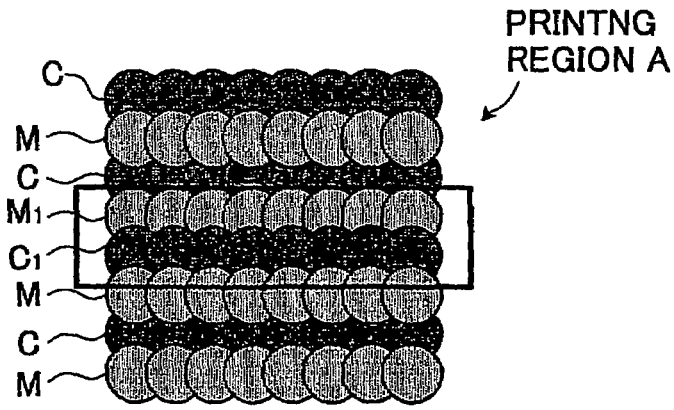

Moreover, FIG. 11A shows the case in which four discharge nozzles at the rear-end portion of the discharge nozzles 13*a* in the array direction and four discharge nozzles at the front-end portion of the discharge nozzles 13*a* in the array direction, which overlap with each other with respect to the sub-scanning direction Y, are determined as being the invalid nozzles. FIG. 11B shows the case in which seven discharge nozzles at the rear-end portion of the discharge nozzles 13*a* in the array direction and seven discharge nozzles at the front-end portion of the discharge nozzles 13*a* in the array direction, which overlap with each other with respect to the sub-scanning direction Y, are determined as being the invalid nozzles.

Specifically, in the cases of FIG. 11A and FIG. 11B, the invalid nozzles determined by the controller 22 are the one or two discharge nozzles 13*a* (the filled-in portions) at the array direction read-end portion of the recording head 13M for the 2nd main scanning, the two or four discharge nozzles 13*a* (the filled-in portions) at the array direction rear-end portion of the recording head 13C for the 3rd main scanning, the four or seven discharge nozzles 13*a* (the filled-in portions) at the array direction rear-end portion of the recording head 13M for the 4th main scanning, the four or seven discharge nozzles 13*a* (the filled-in portions) at the array direction front-end portion of the recording head 13C for the 5th main scanning, the three or five discharge nozzles 13*a* (the filled-in portions) at the array direction front-end portion of the recording head 13M for the 6th main scanning, the one or two discharge nozzles 13*a* (the filled-in portions) at the array direction rear-end portion of the recording head 13M for the 6th main scanning, the two or three discharge nozzles 13*a* (the filled-in portions) at the array direction front-end portion of the recording head 13C for the 7th main scanning, the two or four discharge nozzles 13*a* (the filled-in portions) at the array direction rear-end portion of the recording head 13C for the 7th main scanning, and the four or seven discharge nozzles 13*a* (the filled-in portion) at the array direction rear-end portion of the recording head 13M for the 8th main scanning.

Consequently, the ink drops can reach the target locations on the recording sheet P in order of cyan C and magenta M in the state where magenta M overlaps on cyan C. Thus, it is possible for the present embodiment to prevent the occurrence of color inconsistency on the recording sheet P and attain high-quality printing at the high resolution without reversing the impact sequence of the ink.

As described in the foregoing, according to the ink jet printing device and image forming apparatus of the present invention, the impact sequence of the ink is maintained without being reversed in the case of printing by the high resolution which is higher than the resolution determined according to the array interval of the discharge nozzles, and it is possible to prevent the occurrence of color inconsistency on the recording sheet P, and attain high-quality printing at the high resolution without reversing the impact sequence of the ink. The image forming apparatus in which the ink jet printing device of the present invention is provided as the printing device wherein the head unit is moved in the main scanning direction multiple times for the same printing region in accordance with the array interval of the discharge nozzles is useful for copiers, printers, facsimile, multi-function peripherals, etc.

The present invention is not limited to the above-described embodiments and variations and modifications may be made without departing from the scope of the invention.

The invention claimed is:

1. An image forming apparatus in which an ink jet printing device is provided, the ink jet printing device comprising:

a head unit in which a plurality of recording heads having discharge nozzles which discharge ink drops of different colors respectively are arranged in a main scanning direction, and the discharge nozzles of each of the recording heads are arranged at equal intervals in a sub-scanning direction which is perpendicular to the main scanning direction;

a head-unit moving unit moving the head unit in the main scanning direction along a printing region of a recording medium;

a recording-medium moving unit moving the recording medium in the sub-scanning direction; and a control unit controlling the head unit, the head-unit moving unit, and the recording-medium moving unit, wherein the control unit is configured to carry out printing procedures including steps of moving the recording medium to the printing region to perform the discharging of the ink drops, and moving the recording medium in the sub-scanning direction by an interval represented by H/k where H is an array interval of the discharge nozzles in the sub-scanning direction and k is an integer greater than one, to perform the discharging of the ink drops to a non-printed region equivalent to the array interval H of the discharge nozzles, and configured to repeat the printing procedures k times according to an ink dot density, and thereafter move the recording medium in the sub-scanning direction so that the head unit is located to a next non-printed region following the printing region and the printing procedures are performed for the next non-printed region, wherein the control unit is configured so that a rear-end portion of the discharge nozzles of the $k^{th}$ printing procedure in an array direction after printing of the printing region and a front-end portion of the discharge nozzles of the $k^{th}$ printing procedure in the array direction before printing of the non-printed region overlap each other with respect to the sub-scanning direction, and invalid nozzles that do not discharge the ink drops are determined from among arbitrary ones of the discharge nozzles including in the overlap between said front-end portion and said rear-end portion in the array direction of the discharge nozzles.

2. An ink jet printing device comprising:

a head unit in which a plurality of recording heads having discharge nozzles which discharge ink drops of different colors respectively are arranged in a main scanning direction, and the discharge nozzles of each of the recording heads are arranged at equal intervals in a sub-scanning direction which is perpendicular to the main scanning direction;

a head-unit moving unit moving the head unit in the main scanning direction along a printing region of a recording medium;

a recording-medium moving unit moving the recording medium in the sub-scanning direction; and a control unit controlling the head unit, the head-unit moving unit, and the recording-medium moving unit, wherein the control unit is configured to carry out printing procedures including steps of moving the recording medium to the printing region to perform the discharging of the ink drops, and moving the recording medium in the sub-scanning direction by an interval represented by H/k where H is an array interval of the discharge nozzles in the sub-scanning direction and k is an integer greater than one, to perform the discharging of the ink drops to a non-printed region equivalent to the array interval H of the discharge nozzles, and configured to repeat the printing procedures k times according to an ink dot density, and thereafter move the recording medium in the sub-scanning direction so that the head unit is located to a next non-printed region following the printing region and the printing procedures are performed for the next non-printed region, wherein the control unit is configured so that a rear-end portion of the discharge nozzles of the $k^{th}$ printing procedure in an array direction after printing of the printing region and a front-end portion of the discharge nozzles of the $k^{th}$ printing procedure in the array direction before printing of the non-printed region overlap each other with respect to the sub-scanning direction, and invalid nozzles that do not discharge the ink drops are determined from among arbitrary ones of the discharge nozzles in the overlap between said front-end portion and said rear-end portion in the array direction of the discharge nozzles.

3. The ink jet printing device according to claim 2 wherein the control unit is configured to determine as being the invalid nozzles at least one of the discharge nozzles located in the rear-end portion in the array direction upon a final movement of the head unit in the main scanning direction for printing in said printing region and one of the discharge nozzles located in the front-end portion in the array direction upon a first movement of the head unit in the main scanning direction for printing in the non-printed region.

4. The ink jet printing device according to claim 3 wherein, when k corresponding to a number of repetitions of the movement of the recording medium by the interval represented by H/k in the sub-scanning direction is increased, the control unit is configured to determine as being the invalid nozzles at least one of the discharge nozzles located in the front-end portion in the array direction upon each of movements of the head unit, except for a final movement, in the main scanning direction for printing in the non-printed region.

5. The ink jet printing device according to claim 2 wherein, when a number of the discharge nozzles in said overlap is increased, the control unit is configured to increase a number of the invalid nozzles.

* * * * *